US005992152A

United States Patent [19]

Weres et al.

[11] Patent Number: 5,992,152

[45] Date of Patent: Nov. 30, 1999

[54] METHOD FOR CONTROLLING ELECTRIC CHARGE WITHIN THE EXHAUST HOOD AND CONDENSER OF A STEAM TURBINE

[76] Inventors: Oleh Weres, P.O. Box 116, Vineburg, Calif. 95487; Anatoly Oleksiovych Tarelin, Uberovych St., 50-6, Apt. 114, Kharkiv - 129, Ukraine, 310129; Volodymyr Petrovych Skliarov, Korolenko St. 4 Pivdenny - 2, Kharkiv Oblast, Ukraine, 312118; Yury Ivanovych Serhienko, Prospect Traktorbudivelnykiv 77, Apt. 286, Kharkiv - 120, Ukraine, 310120

[21] Appl. No.: 09/037,902

[22] Filed: Mar. 10, 1998

Related U.S. Application Data

[63] Continuation-in-part of application No. 08/589,420, Jan. 22, 1996, Pat. No. 5,735,125.

[51] Int. Cl.[6] ..... F01B 31/16

[52] U.S. Cl. ..... 60/685; 60/686

[58] Field of Search ..... 60/685, 686

[56] References Cited

U.S. PATENT DOCUMENTS

| | | | |
|---|---|---|---|
| 3,859,005 | 1/1975 | Huebner . | |
| 4,365,476 | 12/1982 | Masuda et al. | 60/686 |
| 4,509,326 | 4/1985 | Jorgensen | 60/648 X |
| 4,629,608 | 12/1986 | Lampton, Jr. et al. | 60/641.2 X |
| 5,483,797 | 1/1996 | Rigal et al. | 60/641.2 |
| 5,735,125 | 4/1998 | Tarelin et al. | 60/685 |

FOREIGN PATENT DOCUMENTS 0141393 8/1983 Japan .

OTHER PUBLICATIONS

Tarelin, Anatoly O. Abstract of ScD Dissertation. Kharkiv State Polytechnical University (Ukraine). Aug. 9, 1994. (Ukrainian language, 120 copies printed.).

*Primary Examiner*—Hoang Nguyen
*Attorney, Agent, or Firm*—Harold D. Messner

[57] ABSTRACT

Sufficient negative charge density may be present in the wet steam flowing through the exhaust hood of a steam power generating unit to cause intense electrical discharges which cause severe corrosion of exposed carbon steel members and generate turbulence, decreasing power output. The electric charge density is proportional to current from a charge probe exposed to the flowing steam to ground. Electric charge density can be controlled by adjusting the concentration of ammonia in the steam supply. A small positive charge density will eliminate corrosion and minimize turbulence related to electrical discharges, thereby increasing power generated. The amount of negative charge released can also be decreased by cladding the portions of the flow guides and other carbon steel members located near to the turbine exhaust with stainless steel, or with an appropriately chosen insulating composition. These improvements may be included in the design of a new power generating unit or provided by retrofitting an existing unit.

28 Claims, 13 Drawing Sheets

METHOD FOR CONTROLLING ELECTRIC CHARGE WITHIN THE EXHAUST HOOD AND CONDENSER OF A STEAM TURBINE

RELATED U.S. PATENT APPLICATIONS

This Application is a Continuation-in-Part of U.S. patent application Ser. No. 08/589,420, filed Jan. 22, 1996 by Tarelin, Serhienko, Skliarov and Weres, now U.S. Pat. No. 5,735,125, which is herein incorporated by reference, to issue.

REFERENCES CITED

U.S. Patent Documents

U.S. Pat. No. 3,859,005 Jan. 19, 1975 Huebner 415/001

Other Publications

J. A. Davis, R. O. James and L. O. Leckie (1978). Surface ionization and complexation at the oxide/water interface. J. Colloid and Interface Science, v.63, pp.480–499.

B. Levy and A. R. Fritsch (1959). Electrokinetic measurements on stainless steel capillaries. J. Electrochemical Society, v. 106, pp. 730–735.

L. B. Loeb (1958). Static Electrification. Springer-Verlag, Berlin.

G. A. Parks (1965). The isoelectric points of solid oxides, solid hydroxides, and aqueous hydroxo complex systems. Chemical Reviews, v. 65, pp. 177–195, Tables I and VI.

W. Stumm and J. J. Morgan (1981) Aquatic chemistry: an introduction emphasizing chemical equilibria in natural waters, 2nd.ed., pp. 617–618, 631. Wiley-Interscience, New York.

O. Weres (1983). The partitioning of hydrogen sulphide in the condenser of Geysers Unit 15. Geothermics, v. 12, pp. 1–15.

O. Weres, A. Yee and L. Tsao (1981). Kinetics of silica polymerization. J. Colloid and Interface Science, v. 84, pp. 379–402.

BACKGROUND OF THE INVENTION

1. Background—Field of Invention

This invention provides methods to measure and control the release of electric charge in the turbine and exhaust hood of a steam power generating unit, whereby harmful electrical discharges that cause corrosion, induce turbulence and decrease power output may be decreased.

2. Background—Discussion of Prior Art

HUEBNER, U.S. Pat. No. 3,859,005 teaches that the size of water droplets in the wet steam flowing through the last stages of a turbine may be reduced and erosion within the turbine thereby decreased by applying an electric potential to stationary surfaces within the turbine and, optionally, also applying an electrical potential to the rotating turbine blades. HUEBNER makes no mention of naturally occurring electrostatic charge in the wet steam, and does not talk about the effects of electrostatic charge in the exhaust hood and condenser of the generating unit.

3. Background—Case Study of Harmful Electrostatic Effects

While we believe the explanations given here to be true, we do not wish to be bound by them. Terms and symbols are defined in the section "Background—Definition of Terms", below.

In U.S. patent application Ser. No. 08/589,420 TARELIN et al. reported measurements of electric charge density in the wet steam exiting a 50 MW turbine in an electric power plant in Ukraine (referred to as "Unit A" hereinafter) indicating a positive electric charge density in the wet steam $\rho_{fg}$=+1mC $m^{-3}$=+1nC $cm^{-3}$.

Similar measurements of electric charge density have been carried out in a modern 800 MW electric power generating unit in the United States (referred to as "Unit B" hereinafter). Both generating units were operating on "All Volatile Treatment", wherein ammonia was added to the feedwater. The pH values and chemical compositions of feedwater and moisture at Units A and B are further discussed in Example 2, below. The method of charge measurement employed is described in Example 1. The design of Unit B is described in Example 5.

Prior to November 1996, ammonia concentration of 800–1400 ppb was maintained in the feedwater of Unit B with feedwater pH in the interval 9.2–9.6, most commonly about 9.2. Since November 1996, the concentration of ammonia in the feedwater has been maintained at 70–90 ppb with feedwater pH in the interval 8.0–8.5. Oxygen has also been added to maintain 60–150 ppb oxygen in the feedwater.

During an outage in March 1997, large corroded areas were first observed on the condenser walls of Unit B in areas where the steam flows down along the walls, and most of the tubular braces inside the condenser of Unit B were severely corroded on their upper surfaces. The corroded surfaces were clean, shiny metal with an etched appearance and feel to it. The outer flow guides of the low pressure turbine were mostly covered with a thin layer of red iron oxide. Most surface analyses of the turbine buckets, nozzles, casings, and other turbine components exposed to steam flow indicated a surface layer consisting mostly of silicon dioxide with iron and other elements present in smaller amounts. The silica contamination is derived from silica carry-over in the steam and is commonly observed in many generating units.

The electric charge carried by water droplets in the turbine exhaust is produced by flow electrification (Loeb, 1958). If ammonia or another volatile base (for example, morpholine) is present in the steam, some of the base will dissolve in the condensate film that forms on the turbine blades and other surfaces within the turbine. If $pH_M$>IEP (isoelectric point) of the oxide film upon the metal surface, the metal surface will release protons to the alkaline condensate. The surface of the metal will have a slight negative charge, which is matched by the positive charge of the diffuse double layer consisting of ammonium ions. Due to the dilute nature of the condensate, the diffuse positive charge extends some distance into the liquid phase ($\kappa^{-1}$ in Table 1 represents this distance; charge density in the diffuse double layer decreases by a factor of $e^{-1}$=0.367879 . . . over a distance of $\rho^{-1}$). When liquid drops are torn from the turbine blades by the rapidly flowing steam, the outer portion of the diffuse double layer is torn away with the drop. The drop thereby acquires a positive charge. High velocity flow of wet steam in contact with other metal surfaces (for example, the nozzles, turbine casing, flow guides, etc.) can also produce electrically charged water droplets. The extreme purity of the liquid water in the wet steam allows large charge separation to occur, because the ability of charge to return through the water to the surface of the metal is limited by the very small conductivity of the condensate.

A negative charge can also be released to the wet steam. The metal oxide-covered metal surfaces usually are amphoteric, and their acid-base properties are primarily determined by the value of IEP, which is different for different materials. Values of IEP for several metal oxides and minerals are summarized in Table 2. If $pH_M$<IEP, the metal surface will have a positive net charge, the charge of the diffuse double layer will be negative, and the wet steam will acquire a negative charge. If $pH_M$=IEP, the surface has no net charge, there is no diffuse double layer, and water droplets separated from the surface of the metal will have no electric charge.

A simple quantitative model of the charge release process is presented in Example 3. This model predicts charge densities of the magnitude actually observed at Unit A and Unit B. It predicts that the positive charge of the wet steam will increase with increasing $pH_M$ and $pH_{FW}$, while the release of negative charge will decrease with increasing $pH_M$ and $pH_{FW}$.

In Unit B, it was found that positive charge was released from the turbine; as predicted the amount of positive charge released increased with increasing $pH_M$ and $pH_{FW}$ (Example 4). Because silica has a very low IEP (Table 2), the presence of silica contamination on metal surfaces inside the turbine readily explains the large amount of positive charge coming out of the turbine at the higher pH values. Negative charge was released from the flow guides and other carbon steel members exposed to high velocity steam flow; as predicted, the amount of negative charge released decreased with increasing $pH_M$ and $pH_{FW}$. At $pH_{FW}$ near to 9.3 the positive charge released from the turbine approximately equaled the negative charge released from the flow guides. Charge density values measured down in the condenser were relatively small, and both positive and negative values were recorded. At $pH_{FW}$<9, negative charge predominated, and substantial negative charge densities were recorded in the upper part of the condenser. These measurements are described in Example 6.

The large negative charge that predominates in the condenser traverses at $pH_{FW}$<9 is probably released by the flow guides and similar members, which are exposed to nearly the same flow velocities as the turbine blades, and have sharp downstream edges, which are conducive to good charge release. The flow guides are made of carbon steel and are covered with a red iron oxide; if the iron oxide present is hydrous $Fe_2O_3$ (that is, common rust) with IEP=8.6 (Table 1) the release of negative charge is to be expected, as $pH_M$<IEP throughout the range of ammonia concentrations of interest (Table 1). Because the presence of oxygen in the steam would favor the formation of rust on carbon steel surfaces, oxygen may also be a factor in releasing the large amount of negative charge observed.

The maximum values of voltage measured on the traverse probes indicates a break-down electric field strength $E_{bd}$=1.3 kV/cm=130 kV/m within the condenser (Example 7). The electric field strength calculated for four of the traverses exceed this value by a large margin, much larger than the likely error in all of the approximations that went into the calculation. It is obvious that electrical discharges are taking place at least in the region that extends from the turbine to the Perpendicular Traverse. At the very large electric field strengths indicated, arc discharges are to be expected, probably resembling little lightening bolts hitting the metal surfaces exposed to the flow. The presence of characteristic corrosion on the upper surfaces of virtually all support braces, even those just above the tube bundle and those down between the tube bundles suggests some degree of electrical discharge activity at all metal surfaces exposed to rapid steam flow.

The calculated charge densities at Unit B summarized in Table 3 are smaller than the +1mC $m^{-3}$ measured at Unit A by a factor of ten or more. The steam leaving the turbine of Unit B is immediately deflected by the several flow guides and baffles, and then flows down the end walls and past the numerous support braces before it gets to the tube bundles. The space charges is rapidly dissipated by discharges to these grounded metal surfaces, as evidenced by the progressive decrease of total estimated current as the tube bundle is approached (Table 3).

At $pH_{FW} \geqq 9$, immediately downstream of the turbine there exists a plume of positive charge released from the turbine surrounded by a zone of negative charge released from the outer flow guide. This zone contains intense electrical discharge activity and turbulence, and the opposite charges dissipate rapidly, consistent with the relatively small charge densities (both positive and negative) observed along the diagonal and perpendicular traverses further down in the condenser.

Release of the positive space charge from the turbine blades produces a moderate anodic polarization along the blade edges where the charged water droplets leave the edge of the blade. This anodic polarization may favor SCC on the trailing edges of the L-stage turbine blades if the current density is large enough. Release of negative space charge produces a moderate cathodic polarization where the charged droplets leave the edges of the flow guides. This moderate cathodic polarization may produce some degree of hydriding at the edges of the flow guides.

Discharges from zones of positive space charge to ground will produce small areas of large cathodic polarization and high current density which persist for a very short time in any one spot. These cathodic "strikes" are likely to be important on the turbine blades and portions of the flow guides at high pH, emanating from the positive charge in the wet steam coming out of the turbine. These discharges may cause hydriding or another form of metal damage associated with cathodic polarization concentrated near to the trailing edges. The damage to stainless steel is not likely to be large in this situation, but titanium alloy blades could be damaged severely.

Discharges of negative space charge to grounded surfaces will produce spots of large anodic cathodic polarization and high current density on the grounded metal surface. This mechanism is consistent with the severe metal wastage observed on the carbon steel braces and condenser walls at Unit B since $pH_{FW}$ was decreased in late 1996. Brass would likewise be severely damaged if exposed to these discharges; for example, brass condenser tubes. Cupronickel condenser tubes might also be damaged. On the other hand, stainless steel and titanium would be damaged little if at all.

The electric field strength is greatest adjacent to a grounded metal surface, and the dissipation of charge will be most rapid, as evidenced by the drop-off in charge density at small values of x in the traverses (FIGS. 6 and 7). With this charge distribution, electrostatic forces induce convection; parcels of fluid with high charge density located at some distance from the metal surface will move toward the surface, displacing parcels of fluid near to the surface which have low charge density. The amount of electrostatic energy dissipated as kinetic energy of turbulence may exceed the amount of energy dissipated through electrical discharge because electrical discharge preferentially removes charge from zones closer to the surface where the electric potential is relatively low, while turbulence removes charge from throughout the profile. This means that at $pH_{FW}$<8 hundreds of kW will be dissipated by electrical discharge, and hundreds of kW as kinetic energy of turbulence. The turbulent motion created will predominantly be perpendicular to the solid surface, thereby favoring the rapid transport of momentum from the bulk fluid to the solid surface. Thus, frictional drag between flowing steam and the solid surface is increased, increasing pressure losses between the turbine and the tube bundles.

The large average velocity of steam leaving the turbine represents substantial kinetic energy (Table 3); turbulence in the steam contains additional kinetic energy. The kinetic energy of the turbulent flow feeds on the average flow, and may far exceed the electrostatic energy that initiates turbulence. The average flow velocity of the steam just above the tube bundle is largely recovered as static pressure as the flow impinges the tube bundle and condenses. The kinetic energy of turbulent flow perpendicular to the average flow will be recovered much less efficiently, if at all. The useless dissipation of most of the kinetic energy associated with turbulence comprises a large efficiency loss related to the electrostatic discharge.

BACKGROUND—DEFINITION OF TERMS

"Back pressure" refers to the static pressure measured in the exhaust hood or turbine neck a short distance away from the last stage of the turbine.

"Breakdown electric field strength" $E_{bd}$ refers to the value of electric field strength necessary to produce an electrical discharge; for example, a corona, a spark, or an arc.

"Charge release regions" are those metallic surface regions exposed to high velocity steam flow near to the turbine which account for most of the charge released to steam within the exhaust hood. The most important charge release regions will be the downstream edges of the flow guides, vertical partition walls, flow baffles, and other flow directing or structural carbon steel members located near to the turbine. Charge will also be released from convex surface regions of these members. Additional charge release regions may be significant, depending on the design of the generating unit.

The "chemical feed rate" can be steady and continuous, it can have an on-and-off pattern controlled to give a certain average feed rate, or it can vary either continuously or in terms of a moving time average, or it can have some other time dependence.

"Control means for said chemical feed means" refers to the electrical circuit or device which regulates the rate of chemical feed provided to the steam, and may also turn it on-or-off.

"Condenser" may be a surface condenser with a large number of heat exchange tubes, a contact condenser where steam is condensed by direct contact with a spray of cooling water, or a shell-and-tube heat exchanger used to condense steam at pressure above atmospheric in a cogeneration facility.

"Condenser pressure" refers to the static pressure measured a short distance above the condenser tube bundles.

"Control probe" is charge probe 90 in FIG. 10 which provides a signal to control unit 92, which adjusts the chemical feed rate (or another volatile base) as needed to maintain the current from the control probe to ground within a predetermined range of values favorable to operation of the method. The control probe can also be connected to a meter or indicator of some kind which a human operator reads prior to adjusting chemical feed rate to keep the value of charge in the steam within a predetermined range of values.

"Control signal" is the signal—an electrical signal, a hydraulic or pneumatic pressure pulse, a mechanical force or displacement through a linkage, or some other kind of signal—by which the charge measurement device or circuit communicates an indication of the value of charge measured to the "control means", allowing adjustment of chemical feed rate in response to the value of electrical charge.

"Corrodible" refers to carbon steel and other, similar ferrous materials which will develop a coating of red rust when exposed to water and oxygen at ordinary temperatures. Due to formation of "rust", these surfaces will tend to release negative charge when exposed to high velocity steam flow.

"Electrical ground" refers to the large electrically continuous mass of metal that comprises most of a power generating unit (turbine housing, generator housing, condenser shell, structural members, tube bundles, etc.) and also to the electric potential of that mass of metal.

"Exhaust hood" refers to the structure which receives steam discharged from the turbine and redirects it toward the upper surface of the condenser tube bundle and the volume within it. In this application, "exhaust hood" is meant to include the entire volume through which steam may flow from the turbine to the upper surface of the condenser tube bundles (or to the water spray region in a contact condenser), and includes the term "turbine neck" of a small generating unit like Unit A as a special case.

"Flow path" refers to the flow path of steam from the turbine to the condenser tube bundle.

"L-stage" =the last stage of the low pressure turbine.

The "low pressure part of a steam power generating unit" refers to the zones within the low pressure turbine, exhaust hood, and condenser of the power generating unit where wet steam is normally present; that is, the part of the power generating unit surrounding the "wet steam flow path" is located.

"Moisture" refers to liquid water dispersed as drops or droplets in the wet steam comprising the turbine exhaust.

"Net charge" refers to the total electric charge passing through the entire area of a plane substantially perpendicular to the flow path. If zones of negative and positive charge flux are present, the negative and positive fluxes are summed in calculating the net charge flux, and partial or complete cancellation results.

"pH controlling chemicals" include ammonia and other volatile bases, boric acid, carbon dioxide, and many other acids and bases.

"Power output" refers to the useful work produced by the steam turbine. Normally power output will refer to electric power, but may also be mechanical power used as such; for example, in a naval propulsion system.

The "predetermined value" of the current from the control probe to ground is chosen to provide optimal operation of the device and method, as determined by testing; the predetermined value of current is corresponds to a predetermined value of charge in the steam. The tests used to determine this value may be done during the design phase, during initial calibration of the charge control system, or periodically or continuously while the system is in operation using manual or automated procedures, or the appropriate predetermined value may be calculated theoretically. The "predetermined value of net charge" can also be defined and correlated with the predetermined value of $I_{Gnd}^{C}$ from a control probe installed in a particular location.

"Redox potential" (also called "Eh") is an abbreviation for "reduction-oxidation potential", which is a measurable electrochemical quantity expressed in volts that reflects the oxidizing and/or reducing tendency of aqueous solution or water. Eh is thermodynamically well-defined in high pressure steam, albeit more difficult to measure. In the case of wet steam, the value of Eh referred to is the Eh of the moisture present in the steam.

"Redox potential controlling chemicals" include oxygen and hydrazine and many other oxidizing or reducing reagents.

"Saturation temperature" is the temperature at which water vapor at a given pressure is in equilibrium with liquid water. It is a function of pressure.

"Space charge" refers to the electric charge present in the wet steam, which largely consists of electric charge associated with water droplets in the wet steam.

A chemical added to the "steam supply", to the "steam" or to the "wet steam" might be added to feed water, the condensate, the make-up water or to some other place in the water loop of the generating unit; regardless of where in the loop the chemical is added, it will be present throughout.

"Steam power generating unit" or simply "generating unit" will normally be an electric generating unit, but may also be a unit that produces mechanical power for direct use; for example, a naval propulsion system or a steam turbine serving as a prime mover in industry.

"Substantially isolated from electrical ground" means that sufficient electrical isolation is provided between the charge probe element and electrical ground to ensure that most of the current collected by the charge measurement probe goes to ground through the microammeter, instead of leaking to ground by stray paths.

"Surface regions which impede the flow of wet steam" refer to the walls of the exhaust hood and the surfaces of structural braces and other members within the exhaust hood that are in contact with the wet steam flowing along or around them, whereby flow of the steam from the L-stage of the turbine to the condenser tube bundle is impeded by the transfer of momentum from the flowing wet steam to these "surface regions", resulting in increased Back pressure and decreased power output.

"Turbine exhaust" refers to the wet steam that flows out from the turbine.

"Turbine neck" is the connecting element which joins the turbine to the condenser in some small generating units like Unit A. In this application, "turbine neck" is to be considered a special case of the term "exhaust hood".

"Volatile bases" include ammonia, morpholine and other amines that are volatile at boiler temperature and may be added to the feedwater to maintain alkaline water chemistry throughout the generating unit.

"Wet steam" describes a two phase fluid mixture comprising mostly water vapor, with a smaller amount by weight of liquid water present in the form of drops or droplets dispersed throughout the vapor phase.

"Wet steam flow path" describes the region extending from the geometric surface within the turbine where moisture droplets first appear to the surface of the tube bundles within the condenser.

A=area of test probe exposed to steam flow c=total concentration of electrolyte in the condensate 1 C=1 Coulomb, a unit of electric charge; 1 mC=1 millicoulomb; 1 $\mu$C=1 microcoulomb; 1 nC=1 nanocoulomb.

$d_f$=density of water $h_{rem}$=thickness of water removed when drops separate from the turbine blades $h_s$=distance of the shear plane from the solid surface of the turbine blade $E_{bd}$=breakdown electric field strength $E_x$=component of electric field in the x direction (measured in megavolts/meter)

I=is the ionic strength of the moisture (measured in moles/liter=M)

$I_{Gnd}$=current to ground from a current probe $I_{Gnd}{}^{C}$=current from the control probe to ground IEP="isoelectric point", which is the pH value of water contacting a solid surface that corresponds to zero net surface charge P=pressure $P_B$=turbine backpressure $P_E$=electrostatic term that contributes to the static pressure $P_{sat}$(T)=equilibrium saturation pressure of water at T; $P_{sat}$(52°)=13.6 kPa ppb=parts-per-billion=$\mu$g/kg≈$\mu$g/L "pH" is minus the common logarithm of the activity of hydrogen ion in liquid water. pH is easily measured in water. pH is thermodynamically well-defined in high pressure steam, albeit more difficult to measure. In the case of wet steam, the value of pH referred to is the pH of the moisture present in the steam.

$pH_{FW}$="feedwater pH"=pH of the feedwater $pH_M$=pH of the moisture in the turbine exhaust $PH_{neut}$=neutral pH; that is, the pH of pure water at the given temperature "PTFE"=polytetrafluoroethylene, a very inert and stable plastic.

T=absolute temperature in degrees Kelvin

Δt=duration of the measurement

V=velocity of the steam flow $v_f$=specific volume of liquid water=0.001013 $m^3$ $kg^{-1}$ at 52° C.

$v_g$=specific volume of water vapor=11.0 $m^3$ $kg^{-1}$ at 52° C. at $P_{sat}$ x=distance from the South Wall in a horizontal section of the condenser $x_f$=mass fraction of liquid water in wet steam $1/\epsilon_0$=$1.13\times10^{11}$ newton•meter•coul=$1.13\times10^{11}$ kg $m^3$ $s^{-2}$ $C^{-2}$.

ϕ=electric potential (measured in megavolts)

1/κ=thickness of the diffuse double layer; that is, the charge density of the double layer will decrease as exp(-kx) where x is the distance from the solid surface.

$\sigma_{DL}$=charge per unit surface area in the diffuse double layer adjacent to a solid surface, equal to minus the net electric charge of the solid surface $\rho_f$=average charge density in liquid phase $\rho_{fg}$=average charge density in wet steam

SUMMARY OF INVENTION

The object of this invention is to increase power output and decrease corrosion in the exhaust hood and condenser of a power generating unit by measuring and controlling electric charge released to steam from the turbine and the various charge release regions (defined above) within the exhaust hood near to the turbine. The invention is particularly advantageous in that its objects may be achieved through simple and inexpensive modifications in the design of the generating unit or by retrofitting an existing unit.

The analysis of test data from Unit B indicates that the amount of negative charge in the steam is large enough to produce intense electrical discharge activity which causes severe corrosion of carbon steel structural members and produces turbulence, which in turn decreases the power output of the generating unit. Therefore, corrosion may be controlled and power output increased by blocking the release of negative charge. Usually, a small net positive charge in the steam will be most advantageous to the objects of the invention. Decreasing excessive values of positive charge in the steam might also increase power output.

The amount of electric charge in the steam is a function of the amount of ammonia or another volatile base added to the feedwater. A system of automatic control which controls ammonia feed rate in response to measured charge may be used to maintain charge density at a predetermined set-point which provides increased power output and decreased corrosion. While an automatic control system is preferred, semiautomatic or even manual control might also be practiced; for example, reading the charge once per shift or day or week or month, and adjusting the chemical feed rate to provide charge within predetermined values.

The release of negative charge may be blocked by coating or covering the charge release regions with an appropriate insulating plastic or resin. An inorganic insulating material may also be used.

The release of negative charge from the charge release regions in the exhaust hood may be decreased and even reversed to release of positive charge by applying stainless steel cladding to cover the charge release regions. Our teaching to apply stainless steel cladding to small surface regions of carbon steel members is surprising and contrary to prior art, which teaches that this practice risks inducing galvanic corrosion. In fact, the electrokinetic separation of negative charge from unclad carbon steel surfaces in the exhaust hood will impose a cathodic polarization upon the carbon steel, protecting it from corrosion, and this is why the suggestion is sound in this context, albeit contrary to teachings of prior art.

Our teaching to apply stainless steel cladding or insulation to the charge release regions near to the turbine in order to prevent corrosion and decrease flow resistance further down in the exhaust hood near to the tube bundles is surprising and contrary to the teachings of prior art, because it presumes an effect of the cladding or insulation at a remote location; this action at a distance is mediated by electric charge in the steam.

Finally, harmful electrical discharges further down in the condenser may be blocked by coating grounded metal members exposed to the steam flow with an appropriate insulating plastic or resin, or an inorganic insulating material. Doing so will tend to decrease turbulence and flow resistance, which is a surprising and unexpected beneficial effect.

DESCRIPTION OF THE INVENTION

The most advantageous amount of charge in the turbine exhaust should be determined by experiment, wherein the power output of the unit, $I_{Gnd}^{C}$ from a suitably positioned control probe, and $pH_{FW}$ are measured while the amount of ammonia or another pH controlling chemical added to the feedwater is gradually varied, all else remaining constant. Those skilled in the art of evaluating the efficiency of power generating units will know how to design an experiment wherein the effect of charge in the turbine exhaust upon power output may be isolated and measured. This experiment will yield a plot of power output versus $I_{Gnd}^{C}$. The value of $I_{Gnd}^{C}$ which gives maximum power output will be the appropriate "preselected value of charge" if maximizing power output is the primary goal.

Negative space charge can cause electrical discharges that corrode carbon steel, brass, and cupronickel alloys. In order to minimize corrosion of carbon steel, the predetermined value of charge should provide nonnegative charge density throughout most or all of the volume of the exhaust hood. A single control probe will collect $I_{Gnd}^{C}$ proportional to charge density at the location of that probe. Correlating values of $I_{Gnd}^{C}$ from probes at different locations will indicate the minimum value of $I_{Gnd}^{C}$ needed to make the space charge throughout most of the exhaust hood and condenser nonnegative. The same preselected value would protect brass or cupronickel condenser tubing.

If you seek to maximize power output while limiting corrosion, the appropriate "preselected value" will be a value of $I_{Gnd}^{C}$ sufficiently positive to provide nonnegative space charge throughout most or all of the exhaust hood and condenser but no higher than necessary for this purpose, in order to avoid decreasing power output significantly. Setting ammonia feed rate higher than necessary will tend to cause release of abundant positive charge, increasing electrical discharges and turbulence and thereby decreasing power output. In the case of Unit B as it existed in at the time of the tests described herein, the optimum ammonia feed rate would provide about 1,000 ppb ammonia in the feedwater, and $pH_{FW} \approx 9.3$, providing small positive net charge. In the past, Unit B operated with ammonia feed in this range, but the practice was abandoned because the large ammonia concentration in the condensate caused rapid failure of ion exchange columns in the feedwater supply system.

Some condensers have titanium tubing, which is severely damaged by hydriding when cathodically polarized. Titanium could be severely damaged by electrical discharges from positive space charge. Therefore, a condenser with titanium tubes should be operated with zero or small negative net charge.

In principle, the amount of charge in the steam may be controlled by fixing the amount of ammonia or another base added to the feedwater, by controlling $pH_{FW}$, or by controlling $pH_M$, using a control system that resembles FIG. 10, but with a pH probe in place of the charge probe. The charge generation mechanism is sensitive to the chemical composition and state of oxidation of the metal surface, and the presence of surface contamination. For this reason, it probably would not be possible to specify a fixed value of ammonia concentration in the feedwater to maintain the charge density desired. Due to variable amounts of carbon dioxide that may be present in the feedwater, the relationship between $pH_{FW}$ and charge density is even less direct. For these reasons, a control system that controls pH or relies on a fixed ammonia feed rate would require periodic calibration of the variable controlled against charge or power output.

Physically modifying the unit by changing the surface composition of the charge release regions will change the relationship between net charge and $pH_M$. Preferably, the charge release regions in the exhaust hood should be provided with stainless steel surfaces, which would increase the release of positive charge relative to negative. In this case, the small value of net positive charge desired would be achieved at much smaller ammonia feed rate. Modified in this way, Unit B would be able to operate with greater power output and much less corrosion with about 85 ppb ammonia in the feedwater, as desired to maximize ion exchanger life.

Suitable insulating materials for application to the charge release regions to block charge release include polyester resins or epoxy resins selected for good insulating properties and adequate endurance life in a wet environment. The resin applied might be reinforced with silica powder or another filler which does not compromise its insulating properties and stability.

The charge release regions could also be modified by applying an appropriate inorganic insulating material. A chemical setting ceramic lining would be appropriate for application in an existing unit. A porcelain enamel could be applied prior to assembly of the exhaust hood, and perhaps even in an existing unit. Aluminum oxide, titanium nitride, boron nitride and other very durable coatings could be applied utilizing methods like chemical vapor deposition, sputtering, and ion plating. Of course, these methods require vacuum processing or stringently controlled atmospheres and could only be applied to members of the exhaust hood prior to assembly.

The composition of the carbon steel surface can be modified by adding to the steam a redox controlling chemical selected to provide the charge release behavior desired; for example, adding oxygen will favor a surface covered with hydrous $Fe_2O_3$ and the release of negative charge, while adding hydrazine or another reducing agent will favor a surface covered with $Fe_3O_4$ and release of positive charge. The redox potential controlling chemical feed rate can be controlled by an automatic system responsive to measured value of charge.

Harmful electric discharges from steam to grounded metal members lower down in the exhaust hood and condenser may be eliminated by covering the grounded metal members with an insulating plastic or resin. In this way, generation of turbulence and corrosion associated with electric discharges may be eliminated, even when charge is present in the steam. This modification would allow efficient operation with a large positive charge density in the turbine exhaust. Operation with a large positive charge density would, for example, be desired if active electrodes are installed to decrease turbulence as described in the Related U.S. Patent Application identified above.

For this application an insulating plastic or resin with dielectric strength greater than the electric field strength at the surface of the metal would be needed. An appropriate inorganic insulating material might also be used. Insulating the metal surface to block electric discharge might actually increase the electric field strength at the surface, by allowing a greater charge density to exist near to the surface. The insulating material would also have to withstand the erosive effects of water droplets and have a useful surface life in that environment. Among solid plastics, thin solid sheets (for example, 20 to 125 milliinches=0.5 to 3. 1 mm thick) of polypropylene (PP) and ultrahigh molecular weight polyethylene (UHMW-PE) are promising candidates due to high dielectric strength and excellent resistance to abrasion and chemical attack. However, covering the metal surfaces with the plastic might be difficult. Tubular support braces might be covered by wrapping the plastic sheet around them and welding the seam or using large cable ties to hold it in place. Hot-rolling the plastic sheet to make plastic "stovepipes" prior to installation would make it easier to cover tubular braces neatly. Large flat or curved surfaces would require attaching the plastic using studs welded to the braces. Some plastics might also be applied as a powder coating.

DESCRIPTION OF PREFERRED EMBODIMENTS

Figure 10:
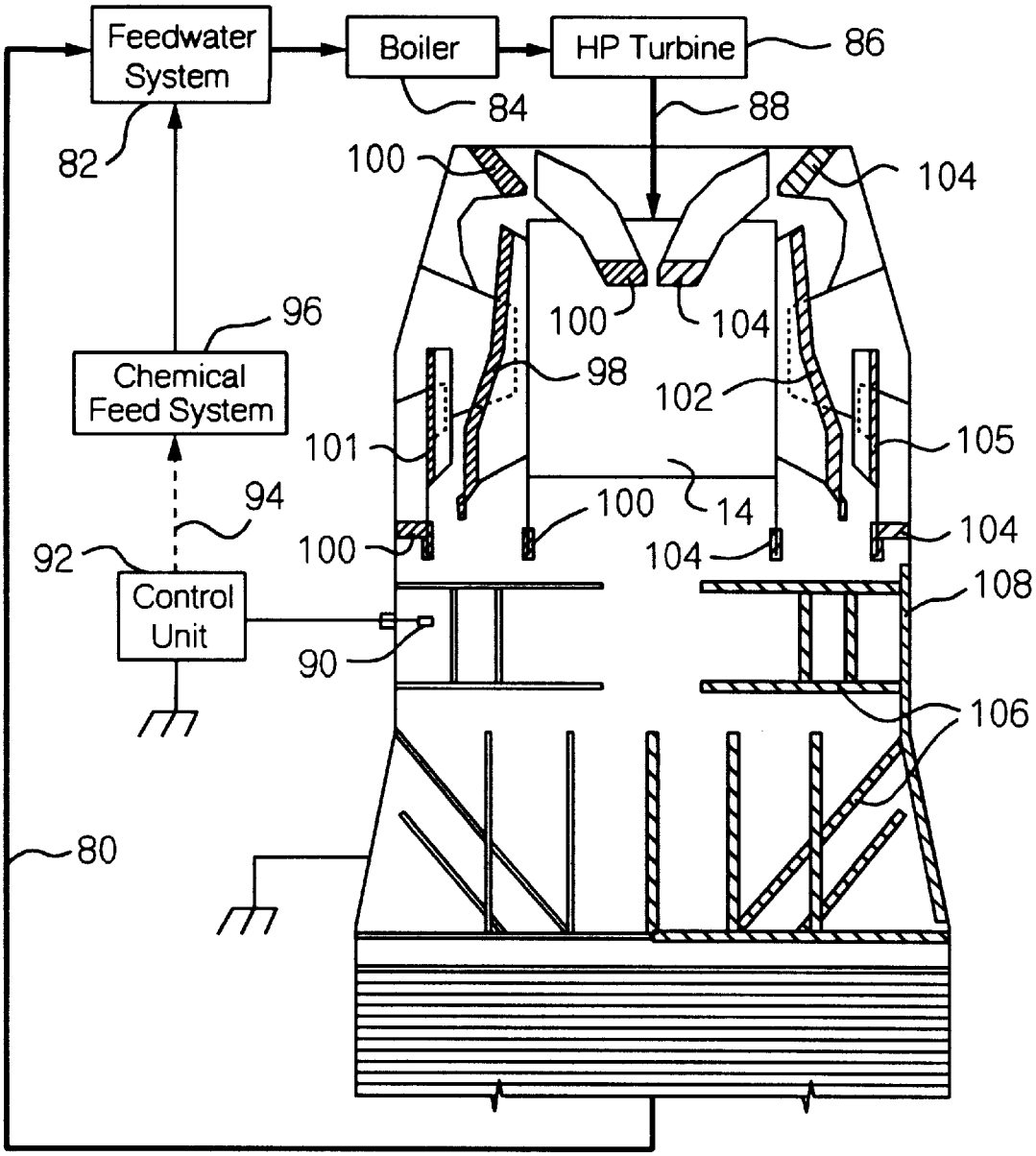
FIG. 10 illustrates the preferred embodiment of the invention as might be implemented in Unit B, including charge control system, stainless steel cladding of charge release regions, and insulating compositions applied to charge release regions and grounded members that impede flow.

FIG. 10 illustrates the preferred embodiment of the invention, as might be implemented at Unit B. One section of the condenser is shown. The structural details of the condenser are also presented and labeled in FIG. 4 and are explained in connection with FIG. 4.

Figure 13:
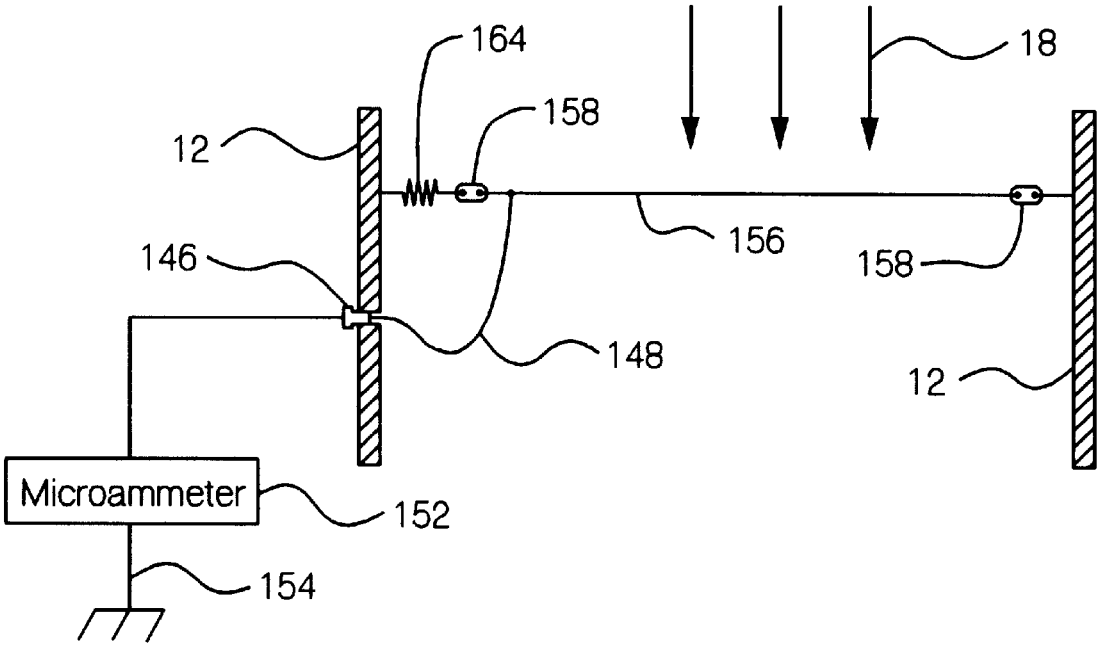
FIG. 13 shows the installation of a charge probe consisting of stainless steel cable that is suspended between two insulators.

In FIG. 10, control probe 90 is a charge probe installed in a convenient location in the path of steam flow within the exhaust hood and connected electrically with control unit 92. A probe similar to FIG. 1 may be used. A long-wire probe may also be used, installed as depicted in FIG. 13. These probes are described in detail under Example 1, below. The control probe may be permanently installed, or it may be movable as used to gather the traverse data. Control unit 92 measures $I_{Gnd}^{C}$ the current from control probe 90 to ground, and sends control signal 94 to chemical feed system 96 as needed to adjust the feed rate of ammonia as needed to maintain $I_{Gnd}^{C}$ within a preselected range. The ammonia is added to the feedwater in feedwater system 82. The feedwater is converted to steam in boiler 84, the steam goes to high pressure turbine 86, and steam 88 leaving the high pressure turbine 86 goes to low pressure turbine 14. Condensate 80 is returned from the condenser to feedwater system 82.

The preferred embodiment of control unit 92 includes a sense resistor connecting charge probe 90 to ground with resistance selected to produce a convenient voltage across it; for example, if current is typically 10 $\mu$A, a 10kΩ resistor will provide a 0.1 V signal. A millivolt controller with input impedance preferably at least 100 times larger than the sense resistor (at least 1MΩ in this example) is connected across the sense resistor, and provides a control signal to chemical feed system 96 as required to maintain the measured value of charge within the predetermined range of values. Process controllers of this description are readily available. An alternative design for control unit 92 comprises a microammeter which provides a voltage output to a millivolt controller which in turn transmits a control signal to chemical feed system 96.

In FIG. 10, the left half of the condenser section illustrates the preferred embodiment, wherein stainless steel cladding is applied to decrease the release of harmful negative charge. Stainless steel sheet is welded to the edge of outer flow guide 98 extending a few inches along the surface inside of the flow guide. The downstream edges 100 of the flow baffles, partition walls, and other structural members exposed to high velocity steam flow near to the turbine are also clad with stainless steel. At the transition from carbon steel to stainless steel, it is desirable to have a relatively thick and slow-flowing condensate film, in order to minimize possible corrosion related to the current loop that would be induced by rapid flow of the condensate film across the junction. Leaving a "step" at the edge of the stainless steel cladding would be one way to accomplish this.

Figure 11:
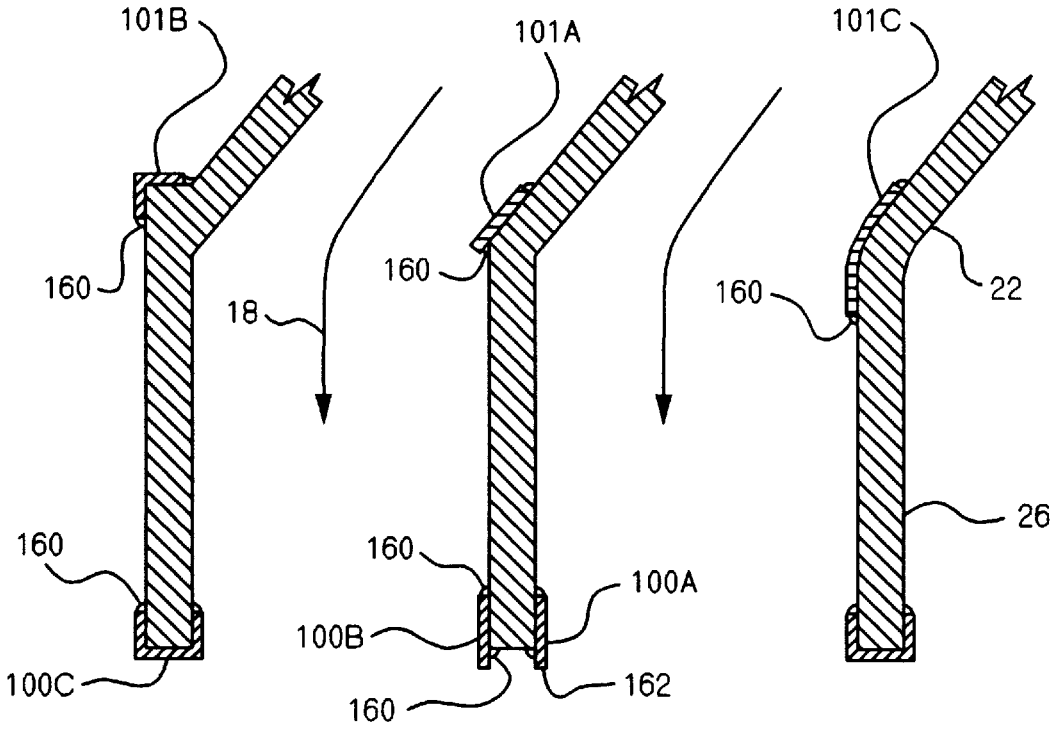
FIG. 11 shows different ways of applying welded metallic cladding to areas on the flow guides and other similar members of the exhaust hood that are exposed to high velocity steam flow and release charge to the wet steam.
Figure 12:
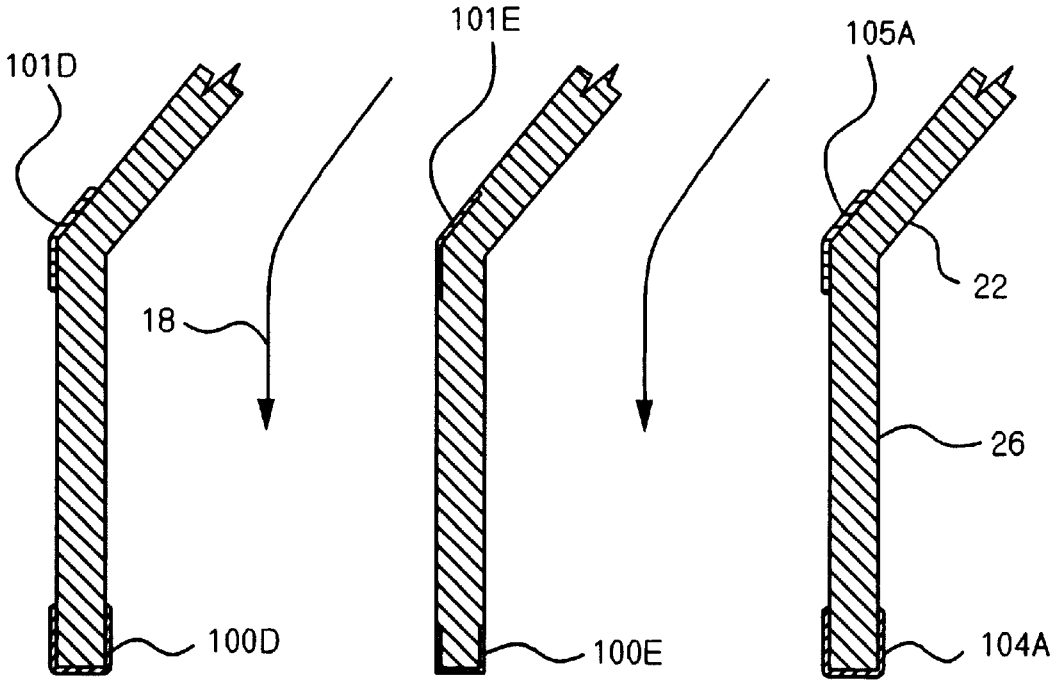
FIG. 12 illustrates provision of a different surface composition to the same areas on the flow guides using other metallic cladding methods, surface modification, and insulating coatings.

FIG. 11 illustrates several ways of applying welded-on metallic cladding (preferably stainless steel) to areas on the flow guides, flow baffles and other metallic members exposed to high velocity steam flow. Charge is released where water is separated from the surface of the flow guides or other members exposed to high velocity steam flow near to the turbine. The largest amount of charge will usually be released from the down-stream edges of the flow guides, etc., and these should be covered with the cladding. Water drops can also be separated and charge released in convex surface regions, and these should be covered as well. The width of the cladding at edges and sharp corners need not be large, because most charge will be released right at the edge. The width of the cladding in these places should be selected to allow easy fabrication. In curved areas, the cladding should begin upstream of the curve, and cover most or all of the curved surface area. FIG. 11 and the application of metallic cladding is discussed in detail in Example 8. The application of bonded metallic cladding and surface alloying techniques are illustrated in FIG. 12 and also discussed in Example 8.

Stainless steel type 304 (approximately Fe-19Cr-9Ni-1Si-2Mn) and type 347 (approximately Fe-18Cr-11Ni-1Si-2Mn-0.8Nb) are known to have low values of IEP and are suited to this purpose (Table 2). Type 304 SS may be arc welded to carbon steel using type 309 or 312 welding wire. Many other stainless steel alloys will also have low values of IEP, recommending them for this application; in particular, other stainless steels alloyed with Cr, Ni, Si and Mn are expected to have similar values of IEP: these include types 301, 302, 304, 305, 308, 309, 310 and 314; still other stainless steels may have similar values of IEP. The IEP of an alloy considered for this application should be determined using electrokinetic measurements like those reported by Levy and Fritsch (1959) or using other suitable methods.

In FIG. 10, the right half of the condenser section illustrates an alternative implementation wherein an insulating plastic or resin is applied to the downstream edges 104 of the flow baffles, partition walls, and other structural members exposed to high velocity steam flow near to the turbine in order to block release of negative charge independent of pH. At the transition from bare metal to insulated metal, it is desirable to have a relatively thick and slow-flowing water film, because otherwise the charge release process would take place right there. Leaving a "step" at the edge of the insulated area would be one way to accomplish this. Preferred application of the insulating composition is illustrated in FIG. 12. It is preferably applied in the same places as metallic cladding: to the downstream edges (104A) of the flow guides, etc., and also to convex surface regions (105A). Extending the insulated zone to cover a larger area extending further upstream might confer some, albeit rapidly diminishing additional benefit.

Additionally, the walls 108 of the condenser, tubular braces 106 and other members exposed to the steam flow are covered with insulating plastic or resin to block harmful discharges within the condenser, thereby preventing generation of turbulence and corrosion related to electrical discharges. This modification would decrease power losses when operating with a large positive space charge.

OPERATION OF THE INVENTION—SUPPORTING DATA AND EXAMPLES

EXAMPLE 1

Measurement of Charge Density

The density of charge in the wet steam is measured by placing an electrical probe in the steam flow. Current flows from the probe to ground through a microammeter. The charge density is calculated as $$\rho_{fg} = \frac{I_{Gnd} f_{corr}}{VA} \tag{1}$$

The "correction factor" $f_{corr}$ formally compensates for several effects which influence the current to ground: (a) the wet steam flows around the probe, decreasing the current; (b) charged water droplets are attracted to the grounded probe, increasing the current; (c) electrical discharges from steam to probe increase the current; and (d) if the local velocity is not known, an average value may need to be used.

Small, Rigid Probe Element

Figure 1:
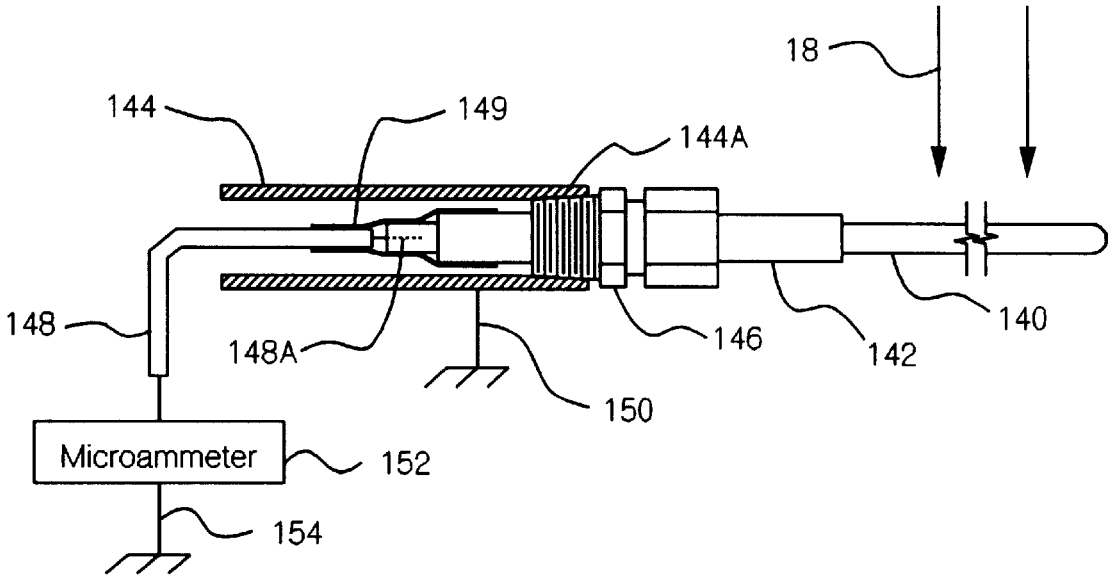
FIG. 1 illustrates the preferred embodiment of a charge density probe with a rigid metallic probe element.

FIG. 1 illustrates the preferred embodiment of a small, rigid charge probe which is easy to fabricate and install. Probe element 140 is a piece of stainless steel rod 0.25 inches=6.35 mm diameter with a rounded tip, preferably about 8 inches=20 cm total length. Probe element 140 is insulated from ground using a piece of plastic tubing 142, preferably PTFE, inner diameter=0.25 inches=6.35 mm, outer diameter=0.375 inches=9.5 mm. About 4 inches=10 cm of probe element 140 is exposed to steam flow 18, with the probe oriented approximately perpendicular to the direction of steam flow 18. Insulated signal lead 148 connects probe element 140 to electrical ground 154 by way of microammeter 152, whereby $I_{Gnd}$ may be determined. A secure electrical connection is provided by drilling a hole 148A in the hidden end of probe element 140 and concentric with it, slipping the exposed conductor of the signal lead into the hole, and securing it to probe element 140 by brazing, soldering, or another suitable method. The electrical connection is insulated and reinforced by applying a length of shrink-fit tubing 149 that extends from insulating tube 142 to the intact insulation of signal lead 148. The probe assembly is conveniently mounted at the end of a length of stainless steel pipe 144 with a female pipe-thread 144A cut inside the end of the pipe; for example, a ⅜-inch female pipe thread may be cut inside the end of a ½-inch pipe. The probe assembly is secured to pipe 144 using a male connector compression tube fitting 146, preferably made of stainless steel, sized ⅜-tube×⅜-MNPT, and drilled-out to provide ⅜ inch or slightly large I.D. through its entire length. A two ferrule type compression fitting is preferred, because it will provide a reliable vacuum seal and good mechanical strength; Gyroloks, Swageloks (both registered trade names) or other similar fittings may be used. One inch=25 mm of insulating tubing 142 is exposed between probe element 140 and compression fitting 146 to provide electrical isolation; the length exposed is not critical. Signal lead 148 runs the length of pipe 144.

The probe configuration depicted in FIG. 1 is well-suited for attachment to the end of a stainless steel pipe, which may be inserted into the exhaust hood through a one-inch ball valve welded to the wall of the exhaust hood. A piece of 1-inch O.D.×1/16-inch wall stainless steel tubing would make a convenient bushing to fill radial gap between the ½-inch pipe and the orifice of the 1-inch ball valve.

If this probe is to be mounted inside of the condenser, it should be attached to a short piece of stainless steel pipe which extends a short distance beyond the end of the shrink-fit tubing, approximately as depicted in FIG. 1. After the probe is fully assembled, the remaining volume within the pipe should be filled with an appropriate water resistant resin to further seal the electrical connection and reinforce it mechanically; for example, an underwater epoxy or an RTV silicone sealant rated for use in a continually wet environment. In this case, signal lead 148 can be made of coaxial cable, with the outer braid grounded.

A probe of this design is also conveniently mounted directly on the outer wall of the exhaust hood. In this case, probe element 140 and insulating tubing 142 are made longer as needed, a hole of appropriate diameter is drilled through the wall, and tube fitting 146 is installed on the outside of the wall; that is, the orientation of the tube fitting is reversed in relation to the probe element. Installed in this way, the probe assembly may easily be removed and replaced with the generating unit operating.

For the reason explained at the end of Example 7, probes of this design cannot be used to measure the very large electrical potentials calculated to exist inside the exhaust hood.

All of the data from Unit B presented in this specification were collected using probes similar to the one depicted in FIG. 1, either permanently installed inside the exhaust hood or condenser, or a traversing probe attached to the end of a long piece of one inch (2.54 cm) heavy-walled steel pipe. The probe was passed through the wall of the exhaust hood or into the turbine casing through a ball valve with bore diameter just over 1 inch (2.54 cm) welded onto the outside wall of the exhaust hood or turbine casing. The major difference was in the diameter of probe element 140; in the probes used at Unit B, the diameter was 5 mm instead of 6.35 mm depicted in FIG. 1.

Long-wire Probe

FIG. 13 illustrates the installation of a charge probe wherein probe element 156 is a length of wire rope or another kind of metallic string suspended between two or more insulators 158 which are attached to opposing walls 12 or other suitable structural members within the exhaust hood. Probe element 156 is exposed to and approximately perpendicular to steam flow 18. Insulators 158 may be the kind used to suspend radio antennas; small "eggshell" insulators are sufficient. To decrease vibration under the influence of the flowing steam, the wire rope is tensioned using spring 164. A 7×7 strand core wire rope, ⅛-inch diameter and made of stainless steel 316 is preferred, secured using appropriate wire rope sleeves or clips. A simple wire, a thin chain, or a thin wire wrapped around a nonmetallic string of some kind might also serve as the probe element. Attachment to walls 12 is conveniently provided using stainless steel eye bolts welded or screwed into the walls. Insulated signal lead 148 is attached to probe element 156 and passes through wall 12 through compression fitting 146. The diameter of the insulated lead wire may be increased to match the tube fitting by wrapping the lead with tape in that place, or putting a piece of rubber tubing over it. Inside the exhaust hood, signal lead 148 is long enough to form a drip loop extending below the elevation of compression fitting 146.

EXAMPLE 2

Calculated Composition and pH of Moisture

The calculated compositions and electrolyte properties of feedwater and moisture in the turbine exhaust corresponding to different concentrations of ammonia in the feedwater at Units A and B are summarized in Table 1.

TABLE 1

Composition of feedwater at 20° C. and moisture in turbine exhaust at 52° C.

| Feedwater | | | Moisture in Turbine Exhaust | | | |
|---|---|---|---|---|---|---|
| $NH_3$ (ppb) | $CO_2$ (ppb) | $pH_{FW}$ | $NH_3$ (ppb) | $pH_M$ | I (μM) | $k^{-1}$ (μm) |
| 0 | 0 | 7.1 | 0 | 6.6 | 0.24 | 0.55 |
| 85 | 160 | 8.2 | 40 | 7.55 | 2.1 | 0.19 |
| 510 | 660 | 9.0 | 115 | 7.9 | 5.3 | 0.12 |
| 850 | 800 | 9.2 | 158 | 8.05 | 6.8 | 0.105 |

The pH values and concentrations in Table 1 were calculated using a computer program called CNDSR that is used for modeling the partitioning and transport of gases in power plant condensers (described by Weres, 1980). The values of $\kappa^{-1}$ were calculated using formulas presented by Stumm and Morgan (1981; pp. 618–619). The composition and pH of the moisture are functions of ammonia concentration only, and may be calculated reliably and unambiguously. The amount of carbon dioxide that may be present in steam does not affect the pH of the moisture ($pH_M$), because the conversion of carbon dioxide dissolved in the moisture to carbonic acid is slow relative to the residence time of the moisture in the turbine, and the aqueous solubility of carbon dioxide is small to begin with. The feedwater pH does depend on the concentration of carbon dioxide in it, which was not measured at either generating unit. In each case, the assumed concentration of carbon dioxide in the feedwater was adjusted to give calculated $pH_{FW}$ approximately equal to the values measured at the given unit. The feedwater pH and $PH_M$ both increase as the concentration of ammonia increases. The feedwater pH is greater than $pH_M$ because all of the ammonia is dissolved in the feedwater, while only a small fraction of the ammonia in the steam is dissolved in the moisture. The difference between the two pH values is not constant, because it is a function of the concentration of carbon dioxide in the feedwater. For this reason, charge density in the turbine exhaust is correlated with $pH_{FW}$, but charge density is not directly a function of $pH_{FW}$.

If morpholine or another amine less volatile than ammonia is added to the feedwater, the concentration of the amine in the moisture will be comparable to the concentration in the feedwater, and $pH_M$ will be larger in relation to $pH_{FW}$; if a significant amount of carbon dioxide is present in the feedwater, $pH_M$ may be greater than $pH_{FW}$. Therefore, dosing the feedwater with morpholine or another organic amine to maintain a certain $pH_{FW}$ would give a higher $pH_M$ than with ammonia, increasing positive charge released from the turbine and decreasing the negative charge released from the rusty carbon steel surfaces of the flow guides.

If other acids and bases are present in the feedwater (e.g. sulfate, chloride, acetate, sodium, potassium) with concentration not much smaller than the concentration of ammonia, their concentration in the moisture will be higher than in the feedwater, and they may have a larger effect upon $pH_M$ than upon $pH_{FW}$.

EXAMPLE 3

Origin of the Charge

The value of IEP will depend on the composition of the metal surface, including impurities which may be present upon it. Parks (1965) notes that the hydrous, poorly crystalline oxides of Al(III) and Fe(III) have IEP values about 2 pH units higher than do well-crystallized, less hydrated or anhydrous oxides of the same oxidation state (Table 2). Levy and Fritsch (1959) reported zeta potential measured in capillaries made of stainless steels type 304 (Fe-19Cr-9Ni-1Si-2Mn) and 347 (similar to 304, but with some Nb & Ta added), which indicate IEP=3 to 4.

TABLE 2

Isoelectric point (IEP) for metal oxides, silicates and stainless steels

| Material | IEP | Reference |
|---|---|---|
| $Al_2O_3$ | 6.7 | Parks |
| $Al_2O_3$ (hydrous) | 9.2 | Parks |
| CuO | 9.5 | Parks |
| $Fe_3O_4$ | 6.5 | Parks |
| $Fe_2O_3$ | 6.7 | Parks |
| FeOOH-α | 7.8 | Stumm & Morgan |
| $Fe_2O_3$ (hydrous) | 8.6 | Parks |
| MgO | 12.4 | Stumm & Morgan |
| NiO | 10.3 | Parks |
| $SiO_2$ (quartz) | 2.2 | Parks |
| $TiO_2$ (rutile) | 4.7 | Parks |
| Albite | 2.0 | Stumm & Morgan |
| Kaolinite | 4.6 | Stumm & Morgan |
| Montmorillonite | 2.5 | Stumm & Morgan |
| 304 Stainless Steel | 3.7 | Levy & Fritsch |
| 347 Stainless Steel | 3.0 | Levy & Fritsch |

Silica and silicate minerals have low IEP values. The silica contaminated surfaces inside the turbine will release positive charge over a wide range of condensate pH, while the rusty steel surfaces of the flow guides are covered with poorly crystalline, hydrous $Fe(_2O_3$ and will release negative charge.

If no volatile bases are present (as in a unit operating with sodium phosphate chemistry) the charge of the double layer will be determined by the intrinsic acid-base properties of the metal surface. The water drops may acquire a positive charge or a negative charge, according to whether the metal surface releases protons or takes protons from the condensate. While the surface charge of metal will be small in the absence of volatile bases in the condensate, the diffuse double layer thickness $\kappa^{-1}$ will be large, and a much larger fraction of the diffuse double layer will be sheared-off and will contribute to the charge of water drops in the turbine exhaust. A similar situation is encountered at the rusty surfaces of the flow guides in Unit B when the ammonia feed rate is small.

The reduction/oxidation (redox) potential in the turbine and condenser is commonly controlled by adding oxidizing agents (usually oxygen or air) or by adding reducing agents (commonly hydrazine or hydrazine precursor compounds). Because redox potential may affect the oxide film upon metal surfaces, redox potential may affect charge release as well. For example, adding oxygen to the feedwater at Unit B probably favored the formation of hydrous iron oxide phases with high values of IEP on the surfaces of the flow guides, thereby favoring the release of negative charge and aggravating the various problems related thereto. Maintaining reducing conditions will tend to maintain a metal surface covered with magnetite, thereby decreasing or stopping release of negative charge.

Case 1:

If T=52° C. and ammonia is the only electrolyte present in the feedwater at 510 ppb (typical of Unit A), then $pH_M$=7.9, and $\kappa^{-1}$=0.12 μm (Table 1). If metal surfaces inside the turbine are covered with a thin film of silica, the electrokinetic properties of these surfaces will resemble silica with IEP≈2.2. Clearly, $pH_M$>IEP, the metal surface will acquire a negative charge, and a positive charge of equal magnitude will be present in the diffuse double layer. Weres et al. (1981) presented formulas and data needed to calculate the surface charge of a silica surface as a function of pH. At $pH_M$=7.9, $\sigma_{DL}$=0.32C $m^{-2}$. This value is consistent with the charge density measured at Unit A if we further assume that $x_f$=0.075, $h_s$=0.6 μm and $h_{Rem}$=15 μm, which are reasonable estimates, given the high steam flow velocities at the L stage of the turbine. Dividing the amount of charge present at a distance from the solid surface greater than $h_s$ by the thickness of the liquid layer removed gives the charge density in the liquid water separated from the surface:

$$\rho_f = \frac{\sigma_{DL}\exp(-\kappa h_s)}{(h_{Rem} - h_s)} = +152\,Cm^{-3} \tag{2}$$

and the average charge density in the wet steam in the turbine exhaust will be $$\rho_{fg} = \frac{v_f x_f}{v_g(1 - x_f)}\rho_f = +1.14\,mCm^{-3} \tag{3}$$

which practically equal to the value typically measured at Unit A, $\rho_{fg}$=+1 mC $m^{-3}$.

Figure 3:
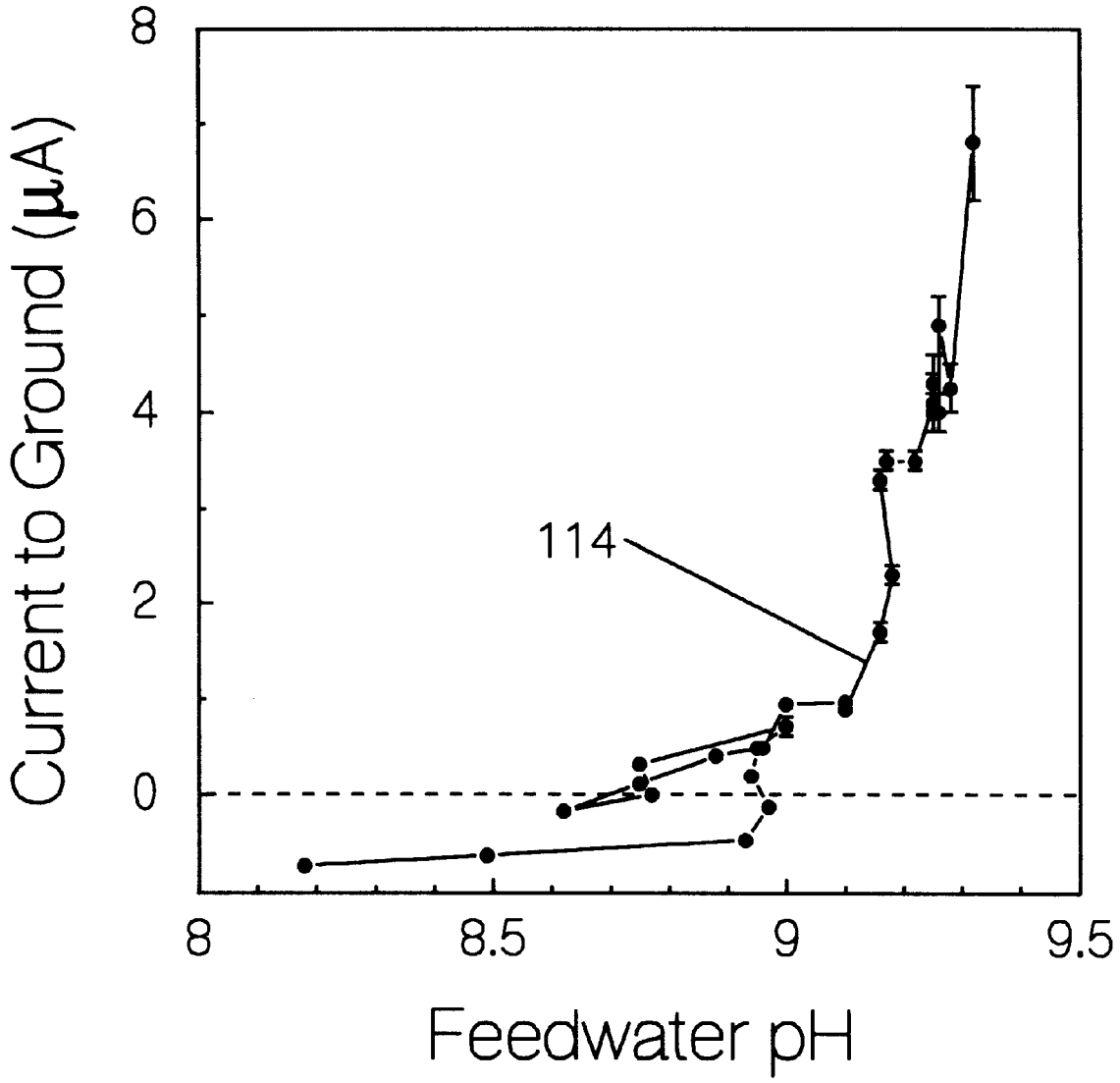
FIG. 3 shows the relation between $pH_{FW}$ and $I_{Gnd}$ (114). These data are interpolated and replotted from FIG. 2.

Case 2:

If no volatile bases are present in the steam, the only electrolyte present in the moisture will be dissociated water, pH=$pH_{neut}$=6.6, and $\kappa^{-1}$=0.55 μm (Table 1). For purposes of argument, we assume that the surface of the outer flow guide is covered with a layer of FeOOH-α, one of several hydrous iron oxides that may constitute "rust", with IEP=7.8. Davis et al. (1978) present titration data for this mineral (op. cit. FIG. 3 and Table II). In this case $pH_M$<IEP and $\sigma_{DL}$=−4.6 C $m^{-2}$. Further assuming that $h_s$=1.2 $\mu$m and $h_{Rem}$=30 $\mu$m (because the relative velocity and shear stress are smaller here than inside the turbine) we obtain, $\rho_f$=−360 C $m^{-3}$ and $\rho_{fg}$=−2.7 mC $m^{-3}$. This calculation confirms that abundant negative charge may be released when wet steam containing little or no ammonia flows over rusty carbon steel surfaces. While the steam at Unit B contains 85 ppb ammonia and has pH=7.55, the rust on the flow guides probably comprises hydrous $Fe_2O_3$ with IEP≈8.6, whereby $pH_M$<IEP by nearly the same amount.

EXAMPLE 4

Charge vs. pH

Figure 2:
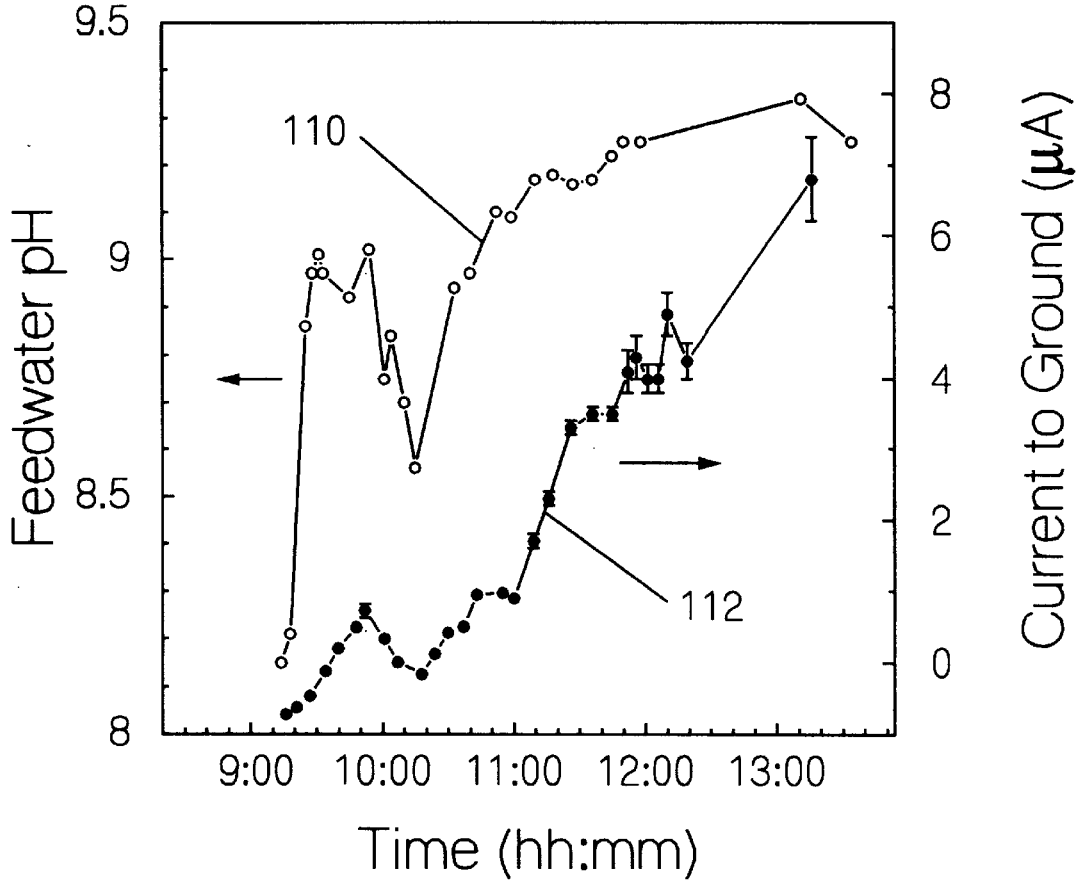
FIG. 2 illustrates the increase in $I_{Gnd}$ (112) from a probe located just below the L-stage of a low pressure turbine in Unit B as $pH_{FW}$ (110) was increased by increasing the amount of ammonia added to the feedwater.

The model of charge release to the wet steam presented above predicts that the increasing $pH_{FW}$ (which will cause $pH_M$ to increase as well) will increase the positive charge released from the turbine while decreasing the negative charge released from the flow guides. This hypothesis was tested at Unit B. The traversing charge probe was placed just below the L-stage of the turbine at the R=1.28 meter position, and ammonia feed rate was gradually increased while $pH_{FW}$ (114) and $I_{Gnd}$ were recorded. The value of $I_{Gnd}$ is proportional to charge density in the wet steam flowing past the probe (Eqn. 1). The large increase in $I_{Gnd}$ (112) with increasing $pH_{FW}$ (110) is shown in FIG. 2. The same data were interpolated and replotted in FIG. 3 to illustrate $I_{Gnd}$ (114) as a function of $pH_{FW}$.

EXAMPLE 5

Description of Unit B

Figure 4:
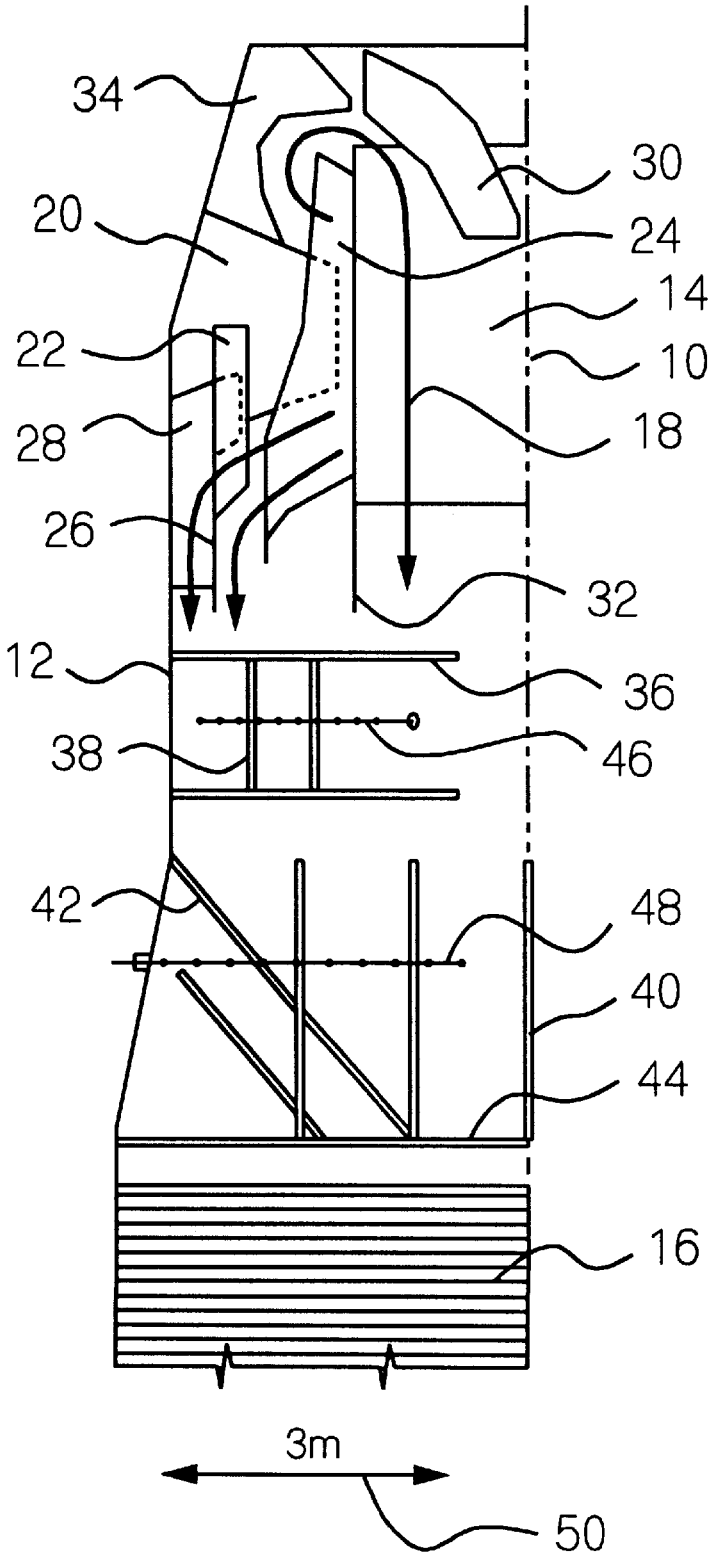
FIG. 4 shows the design of the exhaust hood and upper condenser area at Unit B. One-half of one section of the condenser is illustrated. Unit B's condenser consists of two similar sections. Some parts have been left out of the drawing, and others slightly repositioned or distorted in order to make the drawing more easily legible.

Unit B is a modern 800 MW coal-fired generating unit in the United States. It is plagued by high condenser pressure. Unit B has two dual-flow low pressure turbines and a split condenser. The measurements reported here were made in the "high pressure" section of the condenser. FIG. 4 depicts one-half of one LP turbine 14 along with the corresponding section of the condenser. The condenser section is approximately symmetrical about its center line 10.

Wet steam is discharged from LP turbine 14, toward south end wall 12. Inner flow guide 20, middle flow guide 22, outer flow guide 24, and flow baffles 30 and 28 (there are two of each at either end of the LP turbine) redirect steam flow 18 down towards tube bundle 16. Outer flow guide 24 resembles the mouth of a horn connected to LP turbine 14. Inner flow guide 20 is a truncated cone. Middle flow guide 22 is a half-circular strip cut from a conical surface which is attached to vertical wall 26. Flow baffles 28 are bent; the upper portion lies in a radial plane while the lower section lies in a vertical plane. Flow baffles 28 are attached to end wall 12 and support middle flow guide 22 and vertical wall 26. Another vertical wall 32 is connected to the end of LP turbine 14. Structural brace 34 is cast as part of the upper turbine housing and lies in a vertical plane that contains the axis of LP turbine 14.

Pressure losses in the upper portion of the exhaust hood are compounded by the presence of various steam and water pipes located below LP turbine 14 (not shown in FIG. 4), and numerous tubular braces (carbon steel pipe, mostly 4 inches=10 cm diameter). Diagonal braces 42 and 40 connect the walls to horizontal braces 44 that run the length of the condenser about 50 cm above the upper surface of tube bundle 16. Each corner of the exhaust hood is braced by a "box" of four parallel horizontal braces 36, which cut across the corner at an angle of about 45 degrees to either wall. Braces 36 are connected near their midpoints by a square of four braces 38 lying in a plane perpendicular to braces 36.

The perpendicular and diagonal traverses both lay in horizontal planes. Perpendicular traverse 48 entered the exhaust hood through a ball valve welded to South end wall 12 at a right angle to the wall 2.23 m above tube bundle 16. At maximum insertion, it approached the midline of the condenser section. Diagonal traverse 46 entered the exhaust hood through a ball valve welded to the West wall of the exhaust hood 4.68 m above the tube bundle, at a 40 degree angle from the wall in a horizontal plane. At maximum insertion, it almost touched south end wall 12. Diagonal traverse 46 ran along the centerline of the box formed by diagonal braces 36 in the SW corner of the exhaust hood. Perpendicular traverse 48 passed beneath and was shadowed by diagonal braces 36. The two traverses were located in the region of maximum steam flow relatively near to the turbine exhaust.

The fixed charge probes were attached to horizontal braces 44, which are 52 cm above the top surface of tube bundles 16. Most of fixed charge probes were located beneath and among the many diagonal braces 40 and 42.

EXAMPLE 6

Results of Charge Measurements at Unit B

At the time of the tests reported here, Unit B was operating near to full load with steam flow per section=334 kg/s. Above the tube bundle in the high pressure section, measured P=13.6 kPa and T=52.0° C., moisture content=7.5% by weight, and density of wet steam=0.09845 $kgm^{-3}$.

Figure 5:
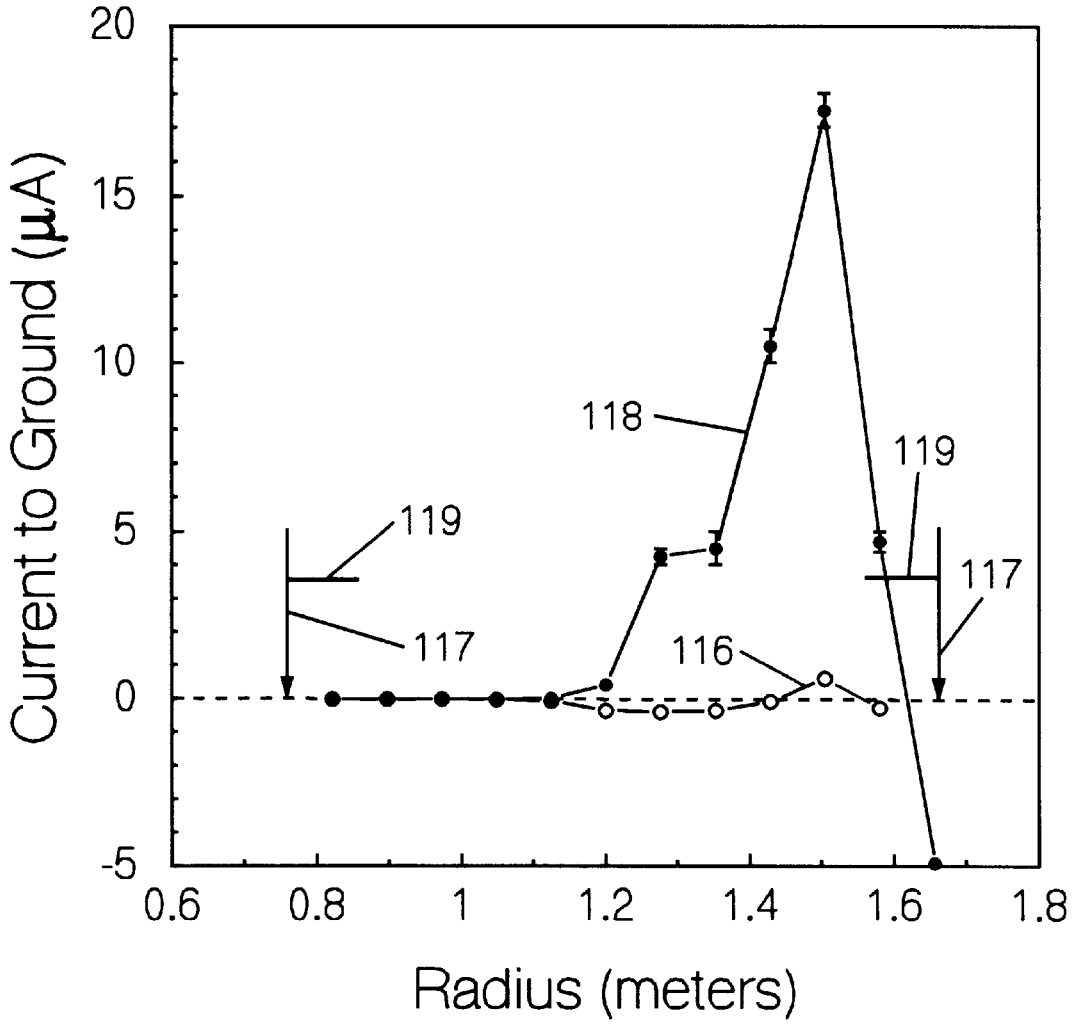
FIG. 5 illustrates the current from traversing probe to ground as a function of radial position just below the L-stage of the turbine at $pH_{FW}$ equal to 8.3 (116) and 9.2 (118).

FIG. 5 shows the current along a radial traverse just below L stage of the LP turbine at pH 8.3 and pH 9.2. Arrows 117 indicate the limits of flow, and line segments 119 represents the length of the charge probe. The current at pH 9.2 (118) was positive and large at R=1.2–1.6 meters, but the sign of the charge reversed at the largest radius, where the probe was approximately aligned with the outer flow guide. At R≦1.1 meters the current was nearly zero due to smaller velocity and much smaller moisture content. At pH 8.3 (116), the charge density was much smaller, and distinct regions of positive and negative charge were evident.

Figure 6:
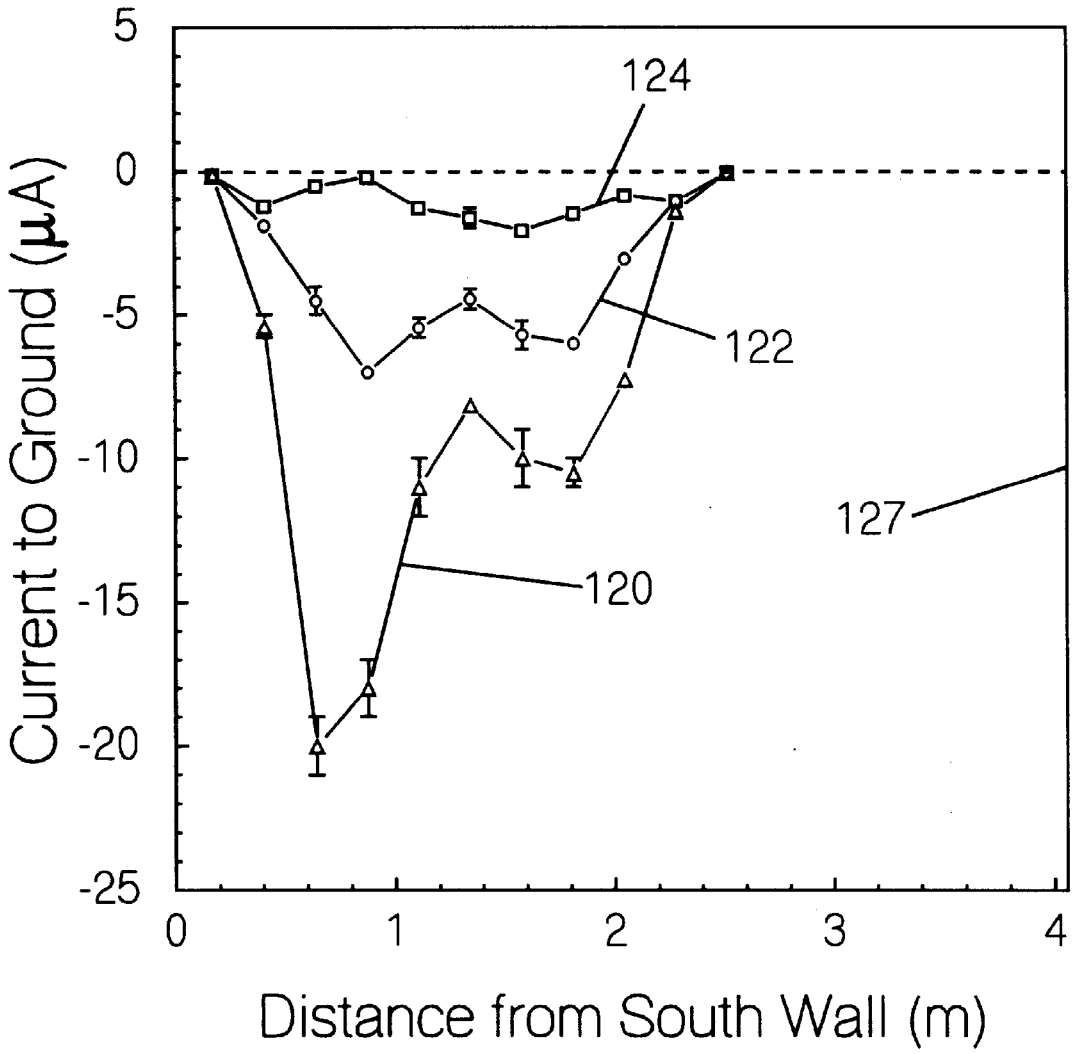
FIG. 6 illustrates the current from probe to ground along the diagonal traverse as a function of distance from the South wall at $pH_{FW}$ equal to 7.7, 8.5 and 9.4.

FIG. 6 shows current measured along the diagonal traverse at $pH_{FW}$=7.7, 8.5 and 9.4 (respectively 120, 122 and 124 in the Figure). The traverse cut across the corner of the exhaust hood. The drop-off as x→0 meters was due to proximity of the South wall and real. The drop-off as x→2.52 meters was an artifact caused by the traverse entering through the West wall at this position; in reality, non-zero charge density probably extended to the midline of the condenser section at x→4.06 meters, which is represented by right edge 127 of FIG. 6. The large peak in the current near to x=1 meter reflects the large flow velocity near to the South wall. The magnitude of the negative charge density increased dramatically with decreasing pH. At pH 7.7(120) and 8.5 (122) a pronounced notch is visible in the plot of current at x=1.2 meters, likely the shadow of the square of braces 38.

Figure 7:
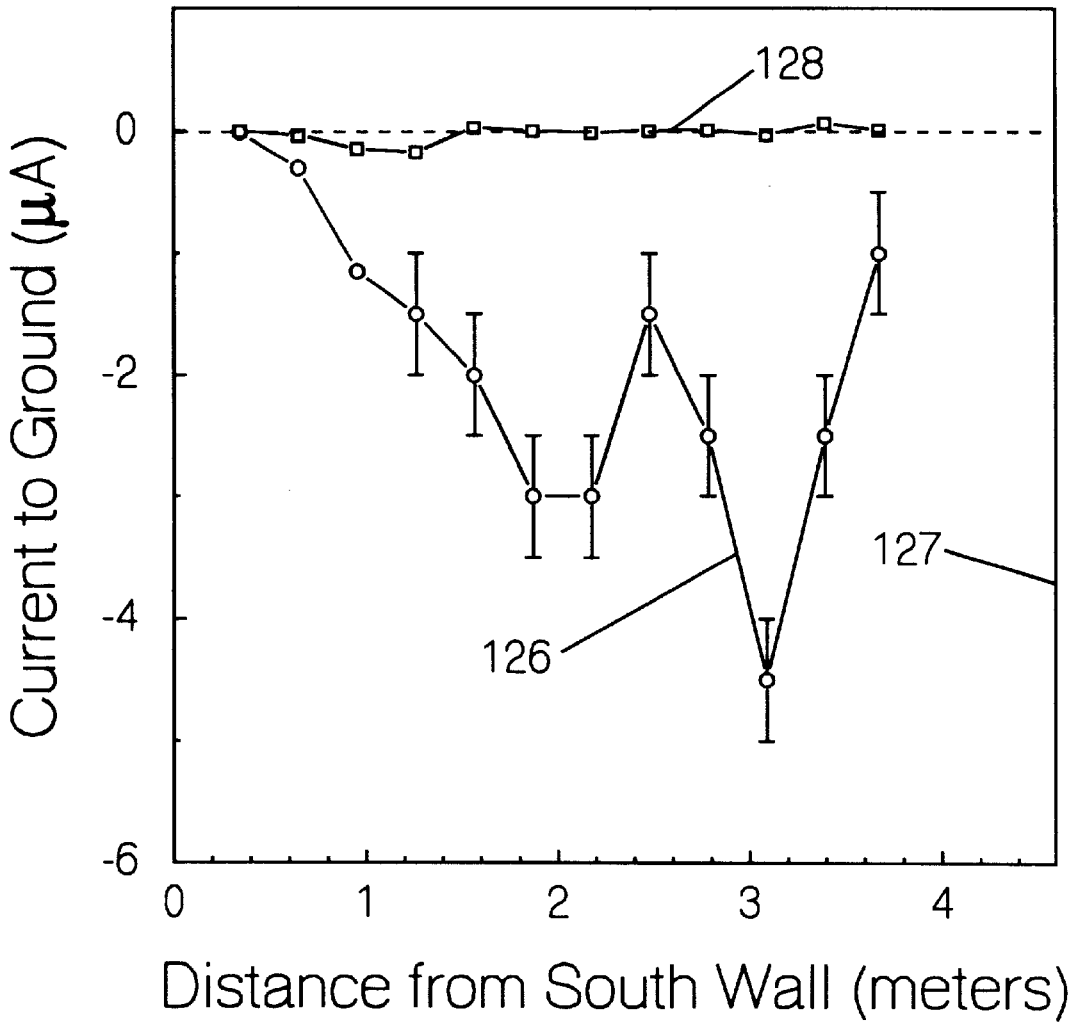
FIG. 7 illustrates the current from probe to ground along the perpendicular traverse as a function of distance from the South wall at $pH_{FW}$ equal to 8.3 and 9.2.
Figure 8:
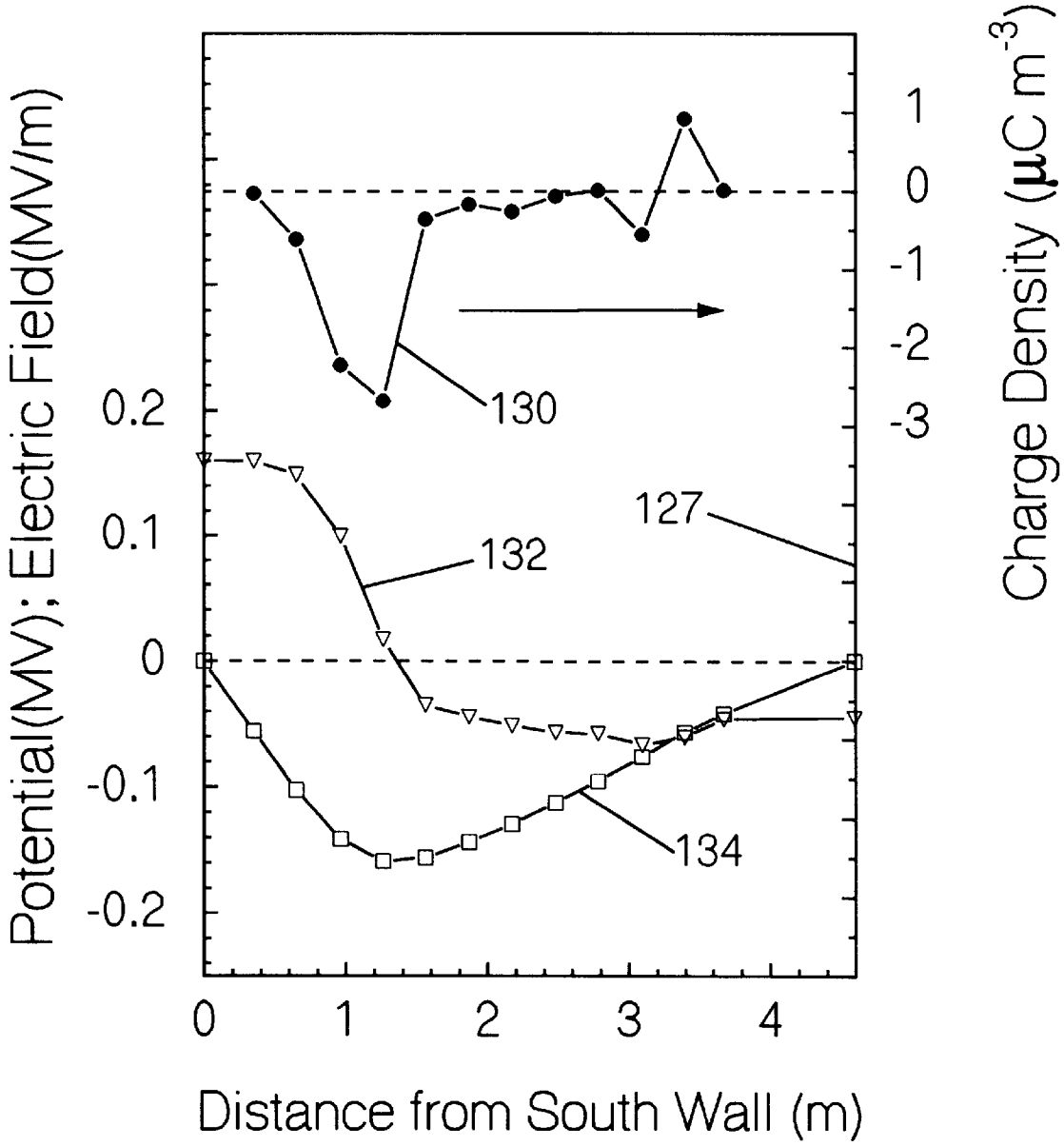
FIG. 8 illustrates the charge density, electric field strength, and electric potential as a function of distance from the South wall calculated from the perpendicular traverse data at $pH_{FW}$ 9.2.

FIG. 7 shows current along the perpendicular traverse at $pH_{FW}$=8.3 and 9.2. The decreasing current toward the mid-line of the condenser (which is represented by the right edge of the FIG. 127) is real, and reflects the velocity distribution. The prominent notch in the plot of current (126) at $pH_{FW}$=8.3 and x=2.5 is the shadow of tubular braces 36 in FIG. 4. The current (128) at $pH_{FW}$=9.2 is much smaller and changes sign; it is negative near to the wall, and becomes positive towards the mid-line of the condenser, represented by edge of the FIG. 127.

Currents from fixed charge probes mounted on horizontal braces 44 were much smaller than from the traversing probes, because the fixed charge probes were only 52 cm above the top of the tube bundle, and hidden beneath the many diagonal braces 40 and 42. At $pH_{FW}$>9 both negative and positive currents were recorded on the fixed charge probes, but positive values predominated.

Table 3 contains estimates of total current passing through each section of the turbine and exhaust hood, corresponding to the locations of the various traverses and charge probes. In all cases, the current was calculated assuming $f_{corr}$=1, and the estimated values may be too large for this reason. Total current at the L stage turbine traverse was calculated by trapezoidal integration of the corresponding data multiplied by $R^2$. Total current through the horizontal cross-section at the elevation of the diagonal traverse was estimated by averaging the current from probe to ground along the traverse, and multiplying this value by the area of this cross-section (49.5 $m^2$) divided by the projected area of the probe (5 $cm^2$). The total current at the other elevations was estimated likewise. Wherever distinct regions of positive and negative current were observed, separate values of total positive and negative current were calculated.

TABLE 3

Estimated total current (mA) at different sections with $f_{corr}$ = 0

| Section | Flow Area ($m^2$) | Average Velocity (m/s) | $P_{dyn}$ (Pa) | Total Current (mA) at pH 7.7 | pH 8.2–8.5 | pH 9.2–9.4 |
|---|---|---|---|---|---|---|
| L stage | 2 × 6.8 | 249 | 3,041 | | −3, +1 | +112 |
| Diag. Traverse | 50 | 69 | 231 | −525 | −224 | −62 |
| Perp. Traverse | 60 | 57 | 160 | | −177 | −3 |
| Fixed probes | 78 | 44 | 93 | | −42 | −6, +4 |

The positive current at $pH_{FW}$=9.2 is most pronounced in the L stage turbine traverse. The substantial negative current at $pH_{FW}$=7.7 and 8.3 is first noted at the level of the diagonal traverse, evidently coming from another source located between the L stage of the turbine and the diagonal traverse. The obvious source of the negative current is the outer flow guide and silmilar members made of carbon steel and exposed to large flow velocities near to the turbine. The rapid decrease of total current as the steam flows down toward the tube bundles indicates rapid dissipation of electric charge through electrostatic discharges to grounded metal members of the condenser, which also explains the distinct notches visible in FIGS. 6 and 7. At $pH_{FW}$=9.2 the positive current from the turbine approximately cancels the negative current from the flow guides, and total current at the lower elevations is small, with regions of both signs evident.

EXAMPLE 7

Calculated Electric Fields and Potentials

The diagonal and perpendicular traverse data indicate the approximate distribution of charge density inside the condenser, allowing the electrostatic potential and related quantities to be calculated by numerical integration, subject to some assumptions and approximations. Rigorous three dimensional expressions are reduced to easily calculated one dimensional integrals over x by assuming that the distribution of charge is quasi-one dimensional; that is, the x-component of the gradient of charge density is much larger than the y- and z-components. In relating charge density to current (Eqn. 1), we assume that the velocity is uniform and equal to the average velocity at the given elevation (Table 3), and set $f_{corr}$=⅓ to compensate for over sampling of the space charge and the various other approximations.

The integral form of Gauss' Law and the definition of electrical potential give electric field strength and electrical potential as a function of x:

$$E_x(x) = E_x(0) + \frac{1}{\epsilon_0}\int_0^x \rho(x')dx' \tag{4}$$

$$\phi(x) = -\int_0^x E_x(x')dx' \tag{5}$$

The boundary value assumed for $\phi$ has no physical significance and has been set equal to zero at x=0, the surface of the grounded South wall. The boundary value $E_x(0)$ was fixed by requiring that $\phi$=0 at the midline of the condenser.

The electric field exerts Coulombic force upon the electric charge in the steam, giving rise to an electrostatic term in the static pressure:

$$P_E(x) = \int_0^x E(x')\rho(x')dx' \tag{6}$$

The boundary value of $P_E$ at x=0 must be set equal to zero at the grounded wall. The electrostatic energy in the steam flowing past either traverse is conveniently described by calculating electrostatic power at that elevation:

$$Power_E = W\int_0^{x_{mid}} \rho(x')\phi(x')|v_z(x')|dx' \tag{7}$$

where W is the width of the steam flow along the South wall of the condenser, $v_z$ is the vertical component of velocity, and the expression is integrated from the South wall at x=0 to the midline of the condenser. The factor of 2 which accounts for two identical halves of the section cancels a factor of ½ that is part of the expression for the local electrostatic energy density. Using W=6.1 meters, which is smaller than the actual width of the exhaust hood, compensates for failure of the quasi-one dimensional approximation near to the East and West walls.

Figure 9:
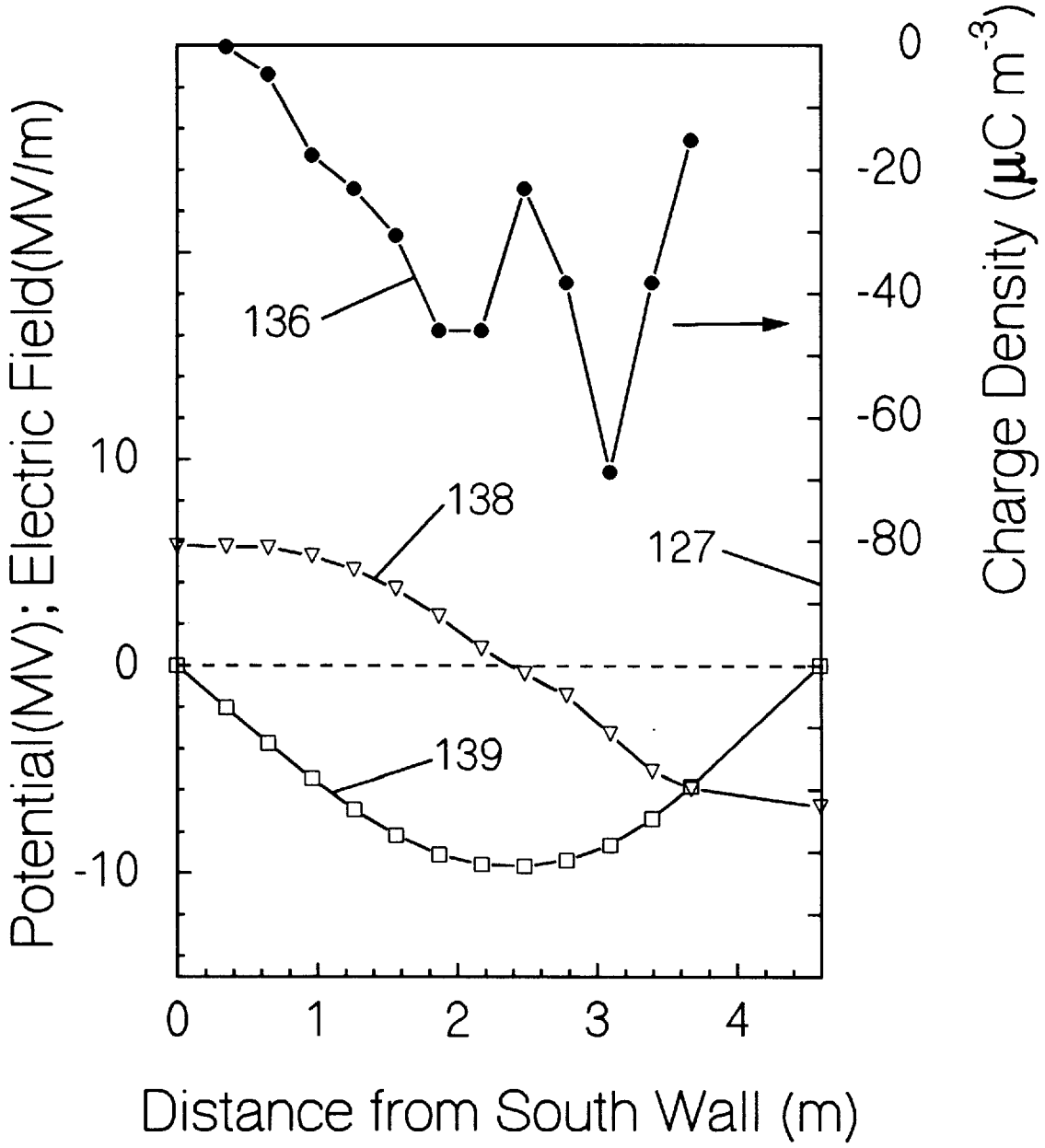
FIG. 9 illustrates the charge density, electric field strength, and electric potential as a function of distance from the South wall calculated from the perpendicular traverse data at $pH_{FW}$ 8.3.

A Fortran program was written to perform these calculations using the five sets of diagonal and perpendicular traverse data. The calculated results are briefly summarized in Table 4, and calculated values of charge density, electric field strength, and electric potential calculated for the two perpendicular traverses are presented in FIGS. 9 and 10.

TABLE 4

Summary of electrostatic calculations with $f_{corr}$ = 1/3

| Traverse | pH | $I_{tot}$ (mA) | Power (kW) | $\rho_{max}$ ($\mu C/m^3$) | $E_{x,max}$ (MV/m) | $\Phi_{max}$ (MV) | $P_{e,max}$ (Pa) |
|---|---|---|---|---|---|---|---|
| Diagonal | 7.7 | −175 | 1,103 | −102 | 16.8 | −14.9 | 1,244 |
| Diagonal | 8.5 | −75 | 222 | −58 | 6.9 | −6.9 | 208 |
| Diagonal | 9.4 | −21 | 17 | −16 | 1.8 | −2.0 | 14 |
| Perpendicular | 8.3 | −59 | 243 | −69 | 5.8 | −9.7 | 146 |
| Perpendicular | 9.3 | −1 | 0.1 | −3 | 0.2 | −0.2 | 0.1 |

The calculated electrical potentials are too large to measure. In the charge probes used (similar to the one depicted in FIG. 1), the probe element was physically removed from electrical ground by only 2.5 cm, and electrical breakdown of the surrounding medium occurred whenever the voltage on the probe reached 3.3–3.5 kV, indicating $E_{bd}$≈1.3 kV/cm=0.13 MV/meter. (This measurement is made with a kilovolt meter in place of the microammeter shown in FIG. 1.) The values of electric field strength calculated from most of the traverse data are much larger than this value, indicating the presence of intense electrical discharges throughout much of the condenser.

EXAMPLE 8

Application of Metallic Cladding

Composite structures wherein a thin sheet of type 304 stainless steel is bonded to a thicker sheet of carbon steel are known in prior art. This combination provides a steel sheet that resists perforation when exposed to water or fog containing chloride ion. Because the exhaust hood and the steam side of the condenser of a power generating unit contain virtually no chloride, prior art would not suggest use of stainless steel cladding on carbon steel in this application.

Most charge will be released at the downstream edges of the flow guides as shown in FIG. 11. If the downstream edge is square and straight, it is most conveniently covered using stainless steel channel stock 100C, attached by welding along both edges 160. Channel stock of the right dimensions can easily be applied to the edge of the flow guide using hand and hammer, then welded into place. Selection of welding rod and conditions needed to reliably weld stainless steel to carbon steel is known to those skilled in the welding art. If the geometry of the downstream edge does not permit covering it with channel stock, stainless steel strips may be applied. If the flow guide or baffle is bent or curved as illustrated in FIG. 11, most charge release will occur on the downstream edge on the concave side, and it is most important to apply the cladding strip 100A to the concave side. Some additional benefit may be gained by also cladding the downstream edge of the convex side 100B. In either case, the cladding strip extends a short distance (preferably 5–10 mm) past the edge, and should be welded 160 on both sides. Optionally providing a serrated edge 162 to the cladding strip (preferably triangular serrations spaced at 2–3 mm) will favor separation of a smaller number of relatively large and uniform drops, thereby minimizing the positive charge released from the stainless steel cladding strip. If erosion of other members downstream of the flow guides is a concern, finer serrations should be used to provide smaller drop size. Some charge may also be released from convex surface regions of the flow guides, and these regions should also be covered. If the convex region comprises a square corner, it will be most conveniently covered using a stainless steel "L" 101B welded 160 at both edges. A non-square convex corner is mostly conveniently treated by welding a stainless steel strip 101A to the upstream plane and extending a few millimeters past the edge. If the surface has a convex region related to smooth curvature, the stainless steel cladding 101C should be rolled or otherwise bent to match the curvature of the surface.

While welding is preferred, stainless steel cladding can also be attached using rivets or other mechanical fasteners. In this case, a sealing compound or gasket should be included underneath the cladding to reduce the possibility of crevice corrosion, and stainless steel fasteners should be used.

The thickness of the cladding is not important, and should be selected to allow for easy fabrication, according to the particular circumstances. Channel stock 100C and L-stock 101B will be most readily available in wall thicknesses 1.5–4 mm or 1/16 to 1/8 inch. Rigid strips 100A and 110A will be easy to handle and weld in a thickness of 1–3 mm. If the material needs to be bent or otherwise shaped to meet the surface contour (101C), thinner sheet-stock 1 m thick or less will be easier to handle.

FIG. 12 illustrates where to apply a thinner, more intimately bonded stainless steel or another metallic cladding using various methods known to those skilled in the art. As in FIG. 11, the cladding should be applied to the downstream edges 100D of the flow guides, etc., and to convex regions 101D. Methods suitable to applying bonded cladding during fabrication include cold rolling, hot rolling, explosive bonding and thermal spray coating. The last two methods among others may be used to apply bonded cladding in an existing exhaust hood.

Because only the composition of the metal surface directly affects charge separation, methods that change the composition of the surface at the edges 100E and convex areas 101E may also be employed. These methods generally require vacuum or special atmospheres, and are therefore best applied to individual parts of the exhaust hood before it is assembled. These methods include vapor deposition, ion implantation, and laser surface processing. Some metal coatings may be applied by electroplating.

CONCLUSIONS, RAMIFICATIONS AND SCOPE

Thus the reader will see that the ability to measure and control the release of electrical charge from surfaces exposed to high velocity steam flow exiting the low pressure turbine of a steam power generating unit allows power output to be increased and corrosion to be decreased within the exhaust hood and condenser.

While our above description contains many specificities, these should not be construed as limitations on the scope of the invention, but rather as an exemplification of preferred embodiments thereof as illustrated in application to one particular design of power generating unit. The invention can benefit power generating units of many different designs, and many other variations are possible, as described below. Accordingly, the scope of the invention should be determined not by the embodiments illustrated, but by the appended claims and their legal equivalents.

While we have described in detail the release, effects, measurement, and control of electrical charge within the wet steam flow path in the low pressure part of a power generating unit, charge separation may occur wherever high purity wet steam flows through an enclosing metallic structure; for example, a pipeline carrying wet steam from a boiling water reactor or from the steam generator in a nuclear power plant, a heat exchanger, a steam jet ejector, etc. The charge in the flowing steam can be measured similarly in all of these cases. In all cases, the release of charge is controlled by the relation of pH of the flowing steam to the value of IEP of surface regions of solid members within the structure which are exposed to high velocity steam flow. In all cases, the release of charge may be controlled by specifying during the design phase, or by later applying or providing a different surface composition to surface regions that release electric charge to the flowing steam utilizing various means, including: applying a superficial metallic cladding, surface alloying, insulating these surfaces with a suitable organic or inorganic insulating material, or replacing the corresponding members with members made of a different material. In all cases, the release of charge may also be controlled by selecting appropriate chemical additives and by adjusting chemical feed rate to change pH or redox potential of the wet steam.

In fact, charge release can occur when dry steam at high pressure rapidly flows past solid surfaces, and the same means of measuring and controlling charge as described in the preceding paragraph can be employed; for example, in a high pressure turbine, or in piping carrying steam from the superheater of a fossil fueled power generating unit. Electrolytes are soluble to some degree in high pressure steam; therefore, a diffuse double layer can exist at a metallic surface, and charge release can occur.

While we have written mostly of adding ammonia or other volatile bases to control pH or adding oxygen to control redox potential, a variety chemicals may be added to the steam to control pH or redox potential. Commonly used pH control chemicals include the bases ammonia, morpholine, and other amines known to those skilled in the art, as well as boric acid. There are, of course, many other acids and bases that might be used; for example, carbon dioxide and acetic acid are weak acids that are both volatile weak acids at boiler temperature, but differ sharply in acid strength, volatility, and hydration kinetics at condenser temperature. Oxygen, hydrazine, and commercially available hydrazine precursors are the most commonly used redox potential controlling chemicals, but many others might also be used; for example, hydrogen or hydrogen peroxide. Redox control chemicals and pH control chemicals may be used together. Acids and bases can also be added together; for example, ammonia plus boric acid or carbon dioxide. In this way, conductivity of the condensate can be varied to some degree independently of pH. Increasing conductivity of the moisture at constant $pH_M$ will decrease the amount of charge released.

We have recommended application of type 304 or 347 stainless steel cladding to decrease release of negative charge because the IEP values of these alloys are known, and they are otherwise suitable. It is very likely that other stainless steel alloys could be used as well, after their IEP values have been determined by suitable tests. It is most convenient to use a commercially available alloy, but novel stainless steel alloys might also be used, provided they have the desired value of IEP, and still other metallic compositions with low IEP probably exist and might be used. Indeed, IEP<4 as has SS 304 is not necessary to block release of negative charge. Providing $EP<pH_M$ will prevent release of negative charge. A titanium surface with IEP≈5 would also release positive charge, and even a carbon steel surface well-passivated with magnetite or hematite would have $IEP \leqq pH_M$.

The value of IEP needed to satisfy the inequality $IEP<pH_M$ depends, of course, upon the value of $pH_M$. Assuming that strongly acidic or alkaline contaminants are practically absent from the steam (usually the case) and no pH control chemicals have been added, $pH_M=pH_{newt}\approx 6.6$. If ammonia or another volatile base is added, $pH_M>6.6$. Consequently, providing IEP<6.6 will guarantee $IEP<pH_M$ regardless of the amount of volatile base added, if any.

If decreased release of positive charge is desired (for example, to prevent damage to titanium condenser tubing) the appropriate surface regions within the exhaust hood should be clad with magnesium, nickel, copper or preferably a copper-nickel alloy (67Ni-33Cu or similar) to provide $IEP>pH_M$. Because CuO and NiO have IEP=9.5 and 10.3, respectively, cupronickel alloys are predicted to have IEP within the range, and they are highly corrosion resistant, being used for condenser tubing in naval propulsion systems. Other suitable alloys for this purpose can probably be identified using appropriate electrokinetic tests. Using an alloy with IEP>9.2 will ensure that $IEP>pH_M$ over the entire practical range of operating conditions with ammonia AVT.

While water resistant epoxies and polyesters have been recommended as insulating resins to block release of charge, other resins may serve as well. Any insulating resin used must first be tested to establish that it will remain in place and retain useful insulating capabilities in this service. Plastic cladding may also be applied for this purpose, using mechanical fasteners or appropriate adhesives.

The stainless steel cladding may be applied to the appropriate surfaces within the exhaust hood while the unit is first assembled, or it can be applied in an existing unit; that is, one that is new but substantially ready to operate, or a unit that has already been operated for some time. Retrofitting an existing unit by cladding, insulating or otherwise modifying appropriate surface regions within the exhaust hood, or by adding a control system to measure and control charge within the exhaust hood by controlling the feed rate of ammonia or other pH control chemicals constitutes an exceptionally attractive retrofit method to increase power output of an existing power generating unit at low cost.

It is most important that the downstream edges and convex surface regions of the flow guides and other surfaces exposed to high velocity steam flow be provided with a modified surface composition (by cladding, insulating, etc.). Modifying just those surface regions of the flow guides, etc., that release the most charge will provide most of the beneficial effect. Probably, no more than about 10% of the total surface area of the flow guides, etc., releases most of the charge and would need to be modified. Up to a point, increasing the surface area modified might confer some additional albeit decreasing benefit. Indeed, the entire carbon steel flow guides could be replaced with stainless steel or another appropriate metal or even with plastic during initial construction of the unit or as a retrofit. However, cladding more than about one-third of the total area of carbon steel flow guides, etc., with stainless steel might cause problems with galvanic corrosion, because in this case the area clad with stainless steel would become significant in relation to the unclad carbon steel area. While ideally all of the downstream edges and convex areas of the flow guides, etc., should be clad with stainless steel or otherwise modified to control charge release, leaving some portion of the charge release regions unmodified would hurt the effectiveness of the retrofit only in rough proportion to the total area of charge release regions left unmodified. In practice, as much of the area of the charge release regions should be clad or otherwise modified as seems practical, without necessarily worrying about the last little bit of cladding or insulation that might be applied.

The presence of a sharp edge at the downstream edge of a flow guide increases the amount of charge released. Eliminating that sharp edge from the design, and providing a smooth, continuous transition from outer flow guide to the wall of the exhaust hood would greatly reduce charge release from this area. That change might be practical in a new generating unit being designed. The flow guides in an exist unit could be modified by welding on a strip of metal that provides a rounded edge, favoring separation of a thicker, slower moving condensate film. There may be similar opportunities to redesign some elements inside of the turbine, to decrease the amount of charge released. The materials of construction within the turbine might also be changed to decrease the release of electrical charge or change the sign of the charge released.

While we refer to a low pressure turbine in our description, the technology provided applies regardless of whether the unit has one, two, or more turbines in series, as long as wet steam exits the final stage of the last turbine.

The electric charge in the turbine exhaust is a strong function of moisture content. Decreasing moisture content by increasing reheating of the steam or by other means will also decrease the amount of electric charge released.

The charge probe designs depicted in FIGS. 1 and 13 are only specific preferred embodiments, and many variations on these specific embodiments are possible; in particular, all dimensions, most details of construction, and the materials of construction may be altered within wide limits. All that matters is that a conductive probe element connected to ground through a current measuring device be exposed to the steam flow, and that this probe element be sufficiently well isolated from electrical ground to avoid losing a significant fraction of the current collected. A simple wire, a chain, or another form of metallic string may be used as the probe element in FIG. 13. While stainless steel is preferred because it has excellent strength, corrosion resistance and durability, other metals or even nonmetallic conductors may be used, especially if exposure of the probe element to the flowing steam is to be of short duration.

Strictly speaking, the charge measurement means depicted in FIGS. 1 and 13 measure the current which the charge probe collects from the flowing steam. The density of electric charge present in the steam is then calculated from the measured value of current using Eqn. 1, subject to various corrections and approximations. For this reason, in the claims we generally do not distinguish "current" and "charge density" which may be measured and calculated in different ways leading to different numerical results, but mostly speak of "charge" in the steam which may be defined in various ways. The "value of charge" may therefore be taken to be charge density, current, or another related physical quantity, and it may, of course, be equal to zero. Beneficial practical use of the measured or calculated values of "charge" will require consistency, a precise operational definition of the quantity used, and careful correlation with other quantities and desired effects.

While we prefer to measure charge in the wet steam in the exhaust hood utilizing means similar to those depicted in FIGS. 1 and 13, other charge measurement means using the same or different physical principles could be employed as well; for example, attenuation of microwave radiation in the wet steam, or measurement of the deflection of the flowing wet steam in response to an applied electric or magnetic field. The "electrostatic" term (that is, the DC component) of the current from the grounding brushes on the turbine shaft to ground will equal the charge released from the rotor, which comprises part of the total charge released from the turbine.

We claim:

1. A method for controlling electric charge in steam having a value of pH and a value of electric charge within an enclosing metallic structure having internal surfaces characterized by values of IEP which are exposed to high velocity steam flow and release electric charge to said steam, comprising the step of controlling the relation of said value of pH to the values of IEP of said internal surfaces.

2. The method of claim 1, wherein the step of controlling the relation of said pH to the values of IEP of said internal surfaces comprises the steps of measuring said value of electric charge, and adding a pH controlling chemical to said steam in an amount which maintains said value of electric charge within a predetermined range of values.

3. The method of claim 2, wherein said enclosing metallic structure is the low pressure part of a steam power generating unit, said steam power generating unit having a power output, and wherein said predetermined range of values is chosen to maximize said power output.

4. The method of claim 2, wherein said enclosing metallic structure is the low pressure part of a steam power generating unit, said steam power generating unit having a power output, and including an exhaust hood having an internal volume, wherein said predetermined range of values is chosen to maximize said power output while providing nonnegative electric charge throughout most of said internal volume, whereby said power output is increased, while electrical discharges that induce turbulence and corrode carbon steel and brass are decreased.

5. The method of claim 1, wherein said step of controlling the relation of said value of pH to the values of IEP of said internal surfaces comprises the step of modifying at least some of said internal surfaces by providing them with a surface composition having a predetermined value of IEP different from the value of IEP of the unmodified internal surfaces.

6. The method of claim 5, including the precursor step of measuring said value of electric charge in said steam.

7. The method of claim 6 wherein said value of pH is no less than 4, and said surface composition is selected from the class consisting of stainless steels, whereby release of positive charge from the modified surfaces is favored, while the release of negative charge is greatly reduced.

8. The method of claim 1 wherein said steam has a value of redox potential and wherein at least some of said internal surfaces are characterized by values of IEP which are affected by said redox potential, and said step of controlling the relation between the value of IEP of these surfaces and said value of pH comprises the steps of measuring said value of electric charge, and adding to said steam a redox potential controlling chemical selected to provide said value of electric charge within a predetermined range of values.

9. A steam power generating unit having a power output, wet steam having a value of pH and a value of electric charge, chemical feed means providing a pH controlling chemical to said wet steam and having a chemical feed rate which is adjustable, an exhaust hood, and a condenser, wherein the improvement comprises further providing means for measuring said value of electric charge, whereby said chemical feed rate can be adjusted to maintain said value of electric charge within a predetermined range of values, whereby said power output can be increased, and corrosion related to electrical discharges within said exhaust hood and said condenser can be decreased.

10. The steam power generating unit of claim 9, further including automatic control means for said chemical feed rate responsive to the measured value of electric charge, whereby said value of electric charge may be maintained within a predetermined range of values automatically.

11. The steam power generating unit of claim 9, also having an exhaust hood which includes internal members made of corrodible steel having surface regions that are exposed to said wet steam flowing at high speed and release electric charge to said wet steam, further including a surface composition applied to said surface regions which differently releases electric charge to said wet steam.

12. The steam power generating unit of claim 11, wherein said value of pH is not less than 4, and said surface composition is selected from the class consisting of stainless steels, whereby the release of negative charge to said wet steam is decreased, decreasing electrical discharges that corrode carbon steel and brass.

13. The steam power generating unit of claim 11, wherein said surface composition is an insulating composition, whereby release of electric charge of either sign to said wet steam is decreased.

14. The steam power generating unit of claim 9, further having an electrical ground, and wherein said exhaust hood includes electrically grounded internal members having surface regions which impede the flow of said wet steam, further including an insulating surface composition applied to said surface regions, whereby electrical discharges causing turbulence in said exhaust hood are decreased, increasing said power output.

15. A method for changing the release of electric charge to wet steam having a value of pH, and a value of electric charge, within a power generating unit having a power output, and an exhaust hood including internal members having surface regions that are exposed to said wet steam flowing at high speed and release electric charge to said wet steam, whereby said method comprises providing said surface regions with a surface composition which differently releases electric charge to said wet steam, whereby said power output is increased and corrosion within said exhaust hood is decreased.

16. The method of 15, wherein said surface composition is provided by applying a superficial cladding having a metallic composition to said surface regions.

17. The method of claim 16 wherein said power generating unit is an existing unit, with the additional precursor step of measuring said value of electric charge.

18. The method of 17, wherein said metallic composition has a value of IEP not greater than said value of pH, whereby the release of negative charge to said wet steam is decreased, decreasing electrical discharges which may corrode carbon steel or brass.

19. The method of claim 18, wherein said metallic composition is selected from the class consisting of stainless steels.

20. The method of 17, wherein said metallic composition has a value of IEP not less than said value of pH, whereby the release of positive charge to said wet steam is decreased, decreasing electrical discharges which may damage titanium.

21. The method of claim 15, wherein said surface composition comprises an insulating composition, whereby release of electric charge of either sign is decreased.

22. The method of claim 21 wherein said power generating unit is an existing unit, with the additional precursor step of measuring said value of electric charge.

23. The method of claim 22, wherein said insulating composition comprises an organic insulating material optionally including an inorganic filler.

24. The method of claim 22, wherein said insulating composition comprises an inorganic insulating material.

25. A method for measuring electric charge in flowing steam within an enclosing metallic structure having an electrical ground and a steam flow path, comprising the steps of providing an electrically conductive probe element which is disposed in said steam flow path, and at least partially exposed to said flowing steam, and connected to said electrical ground through a current measuring device, but is otherwise substantially isolated from said electrical ground, and measuring the current from said probe element to said electrical ground, whereby the current from said probe element to said electrical ground will be approximately proportional to the electric charge present in said flowing steam.

26. The method of claim 25, wherein said enclosing metallic structure is the low pressure part of a steam power generating unit.

27. The method of claim 25, wherein said electrically conductive probe element is a rigid metallic probe element.

28. The method of claim 25, wherein said electrically conductive probe element is a metallic string suspended between at least two insulators.

* * * * *